US009174475B2

(12) United States Patent
Ueshima

(10) Patent No.: US 9,174,475 B2
(45) Date of Patent: Nov. 3, 2015

(54) IMAGE RECORDING APPARATUS, AND METHOD AND RECORDING MEDIUM FOR OPTIMIZING DEFECTIVE-RECORDING-ELEMENT COMPENSATION PARAMETER

(71) Applicant: FUJIFILM Corporation, Tokyo (JP)

(72) Inventor: Masashi Ueshima, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/467,443

(22) Filed: Aug. 25, 2014

(65) Prior Publication Data

US 2015/0062233 A1 Mar. 5, 2015

(30) Foreign Application Priority Data

Aug. 27, 2013 (JP) ..... 2013-175604

(51) Int. Cl.
*B41J 29/393* (2006.01)
*B41J 2/165* (2006.01)

(52) U.S. Cl.
CPC ..... *B41J 29/393* (2013.01); *B41J 2/16579* (2013.01)

(58) Field of Classification Search
CPC ..... B41J 2/0451; B41J 2/2139; B41J 2/2142; B41J 2/16579; B41J 2002/165; B41J 2002/16
See application file for complete search history.

(56) References Cited

U.S. PATENT DOCUMENTS

2012/0050377 A1 3/2012 Ueshima

FOREIGN PATENT DOCUMENTS

EP 2422984 A1 * 2/2012 ..... B41J 2/045
JP 2012-071474 A 4/2012
JP 2012-210773 A 11/2012

OTHER PUBLICATIONS

The extended European search report issued by the European Patent Office on Feb. 6, 2015, which corresponds to European Patent Application No. 141822932-1701 and is related to U.S. Appl. No. 14/467,443.

An Office Action; "Notification of Reasons for Rejection," issued by the Japanese Patent Office on Jun. 25, 2015, which corresponds to Japanese Patent Application No. 2013-175604 and is related to U.S. Appl. No. 14/467,443; with English language partial translation.

* cited by examiner

*Primary Examiner* — Julian Huffman
(74) *Attorney, Agent, or Firm* — Studebaker & Brackett PC

(57) ABSTRACT

In the optimization of a non-discharge correction parameter for correcting a non-discharge using a non-discharge correction nozzle, a first test chart including a non-recording region that is the recording position of the non-discharge correction nozzle, a measurement chart region where a measurement chart is formed, and a uniform concentration region is formed for a designated nozzle that is previously designated. Then, the first test chart is read, the reading data is analyzed, the concentration at the measurement chart and the concentration at the uniform concentration region are compared for each non-discharge correction parameter, and a non-discharge correction parameter corresponding to the concentration at the measurement chart that minimizes the concentration difference from the uniform concentration region is derived as the optimum value of the non-discharge correction parameter for the designated nozzle.

13 Claims, 20 Drawing Sheets

IMAGE RECORDING APPARATUS, AND METHOD AND RECORDING MEDIUM FOR OPTIMIZING DEFECTIVE-RECORDING-ELEMENT COMPENSATION PARAMETER

CROSS-REFERENCE TO RELATED APPLICATIONS

The patent application claims priority under 35 U.S.C. §119 to Japanese Patent Application No. 2013-175604, filed on Aug. 27, 2013. Each of the above application(s) is hereby expressly incorporated by reference, in its entirety, into the present application.

BACKGROUND OF THE INVENTION

1. Field of the Invention

The present invention relates to an image recording apparatus, and an apparatus, method and a recording medium for optimizing a defective-recording-element compensation parameter, and particularly, relates to a correction technique for a defective recording element including a non-discharge nozzle in an image recording apparatus such as an ink-jet recording apparatus.

2. Description of the Related Art

In the image recording by the ink-jet method, a nozzle in a non-discharge state (non-discharge nozzle) is produced by a clogging or a malfunction in association with use of an ink-jet head. In the case of the image recording by the single pass method, a white line is recognized at the position for the non-discharge nozzle in an image, and therefore, a correction (compensation) is necessary. To date, many correction techniques for the non-discharge nozzle have been proposed.

When the white line caused by the production of the non-discharge nozzle appears, the image recording by non-discharge correction nozzles, which are normal nozzles close to the non-discharge nozzle, is deepened, and thereby, the visibility of the white line is decreased. Examples of the method for deepening the image recording by the non-discharge correction nozzles include a method of scanning an output image, a method of intensifying a discharge signal and rectifying the discharge dot diameter such that it is increased, and the like.

A non-discharge correction parameter indicating the correction intensity in the non-discharge correction nozzle depends on the degree of the variability among nozzles in the impact position errors of the ink to be discharged from the nozzles, and the degree of the variability in the amount of the ink to be discharged from the nozzles, and therefore, the optimum values are different values for each nozzle.

However, the number of nozzles in an ink-jet head to perform the image recording by the single pass method, which is several thousands to several tens of thousands, is very high, and it is required that a technique for optimizing all these many nozzles has an efficient optimizing scheme.

Japanese Patent Application Laid-Open No. 2012-71474 describes a correction technique for a defective recording element that utilizes a defective-recording-element compensation parameter selection chart. The defective-recording-element compensation parameter selection chart is configured by a reference patch and a measurement patch. The reference patch is configured by a uniform image that has a constant gradation and a uniform concentration and in which a region on a recorded medium is drawn.

In the measurement patch, one or plural of a plurality of recording elements to draw the reference patch is in a non-recording state, and a candidate value of a defective-recording-element compensation parameter indicating a correction amount is given at the drawn part by a recording element to perform the recording near the non-recording position for the recording element of the non-recording. Further, the measurement patch reproduces a state after the correction by the correction amount corresponding to the candidate value of the defective-recording-element compensation parameter.

Then, the defective-recording-element compensation parameter selection chart is read by an optical reading apparatus. In the calculation of an evaluation value that is an evaluation index for evaluating the difference between a capture image for the reference patch and a capture image for the measurement patch, a weight reflecting the recording property of a recording head for recording the reference patch is given to a value indicating the difference between the capture image for the reference patch and the capture image for the measurement patch, and the evaluation value is calculated. Then, the defective-recording-element compensation parameter is calculated based on the evaluation value.

The correction technique described in Japanese Patent Application Laid-Open No. 2012-71474 can efficiently select the defective-recording-element compensation parameter, in the case of targeting only particular recording elements.

SUMMARY OF THE INVENTION

However, in the correction technique described in Japanese Patent Application Laid-Open No. 2012-71474, when a defective recording element already exists, there is a possibility that the reference patch is not drawn at a uniform concentration. The reason why the reference patch is not drawn at a uniform concentration is because the defective recording element is included in the recording elements to draw the reference patch, because the defective-recording-element compensation parameter when the reference patch is drawn is not the optimum value, or the like.

If the reference patch is not drawn at a uniform concentration, there is a possibility that the defective-recording-element compensation parameter fails to be optimized, when the evaluation value for evaluating the difference between the reading image for the measurement patch and the capture image for the reference patch is not an appropriate value.

The present invention has been made in view of such circumstances, and has an object to provide an image recording apparatus to efficiently optimize the defective-recording-element compensation parameter for a designated recording element such as an existing defective recording element, and an apparatus, method and a recording medium for optimizing the defective-recording-element compensation parameter.

For achieving the above object, an image recording apparatus according to the present invention including: a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element; a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, in which the defective-recording-element compensation parameter optimizing apparatus comprises an analyzing device which analyzes reading data obtained by the reading device, which compares a concentration of the measurement chart with the concentration of the uniform concentration region for each defective-recording-element compensation parameter, and which, as an optimum value of the defective-recording-element compensation parameter for the designated recording element, derives a defective-recording-element compensation parameter corresponding to a concentration of the measurement chart that minimizes a concentration difference from the uniform concentration region.

According to the present invention, when the defective-recording-element compensation parameter for a designated recording element previously designated is optimized, the measurement chart to which the plurality of defective-recording-element compensation parameters are continuously or intermittently given is used, and the defective-recording-element compensation parameter that minimizes the difference value between the concentration value of the measurement chart, which is given to the measurement chart for each defective-recording-element compensation parameter, and the concentration value at the uniform concentration region is derived as the optimum value of the defective-recording-element compensation parameter for the designated recording element. Therefore, the defective-recording-element compensation parameter for the designated recording element is efficiently optimized.

DETAILED DESCRIPTION OF THE PREFERRED EMBODIMENTS

Hereinafter, preferable embodiments of the present invention are described in detail, with reference to the accompanying drawings.

[Basic Principle of Non-Discharge Correction]

Figure 1:
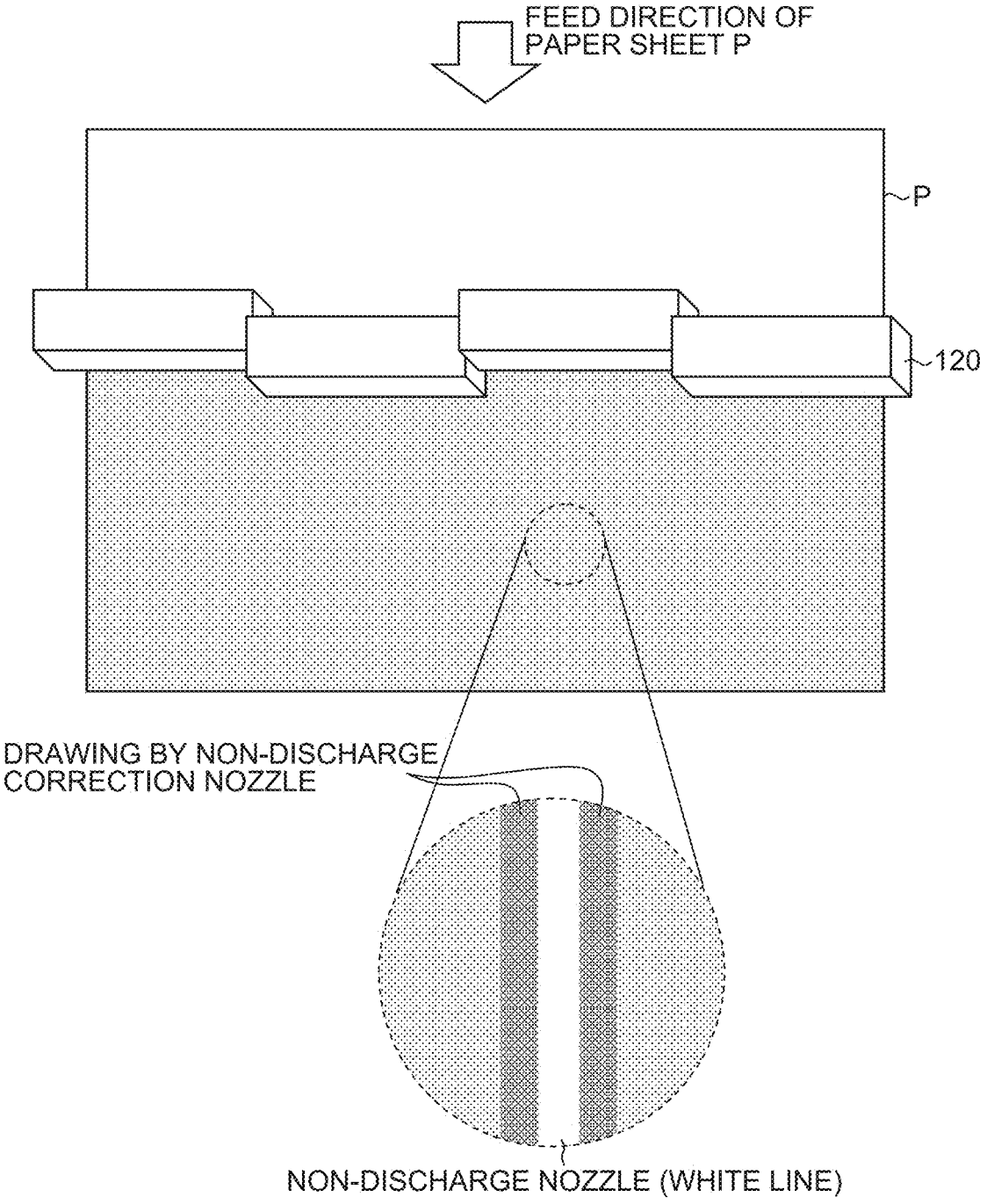
FIG. 1 is an explanatory diagram for the basic principle of a non-discharge correction.

FIG. 1 is an explanatory diagram for the basic principle of a non-discharge correction. The figure schematically illustrates a state in which, using a full-line type ink-jet head 120, the ink-jet head 120 and a paper sheet P are relatively being moved along the feed direction of the paper sheet P (which is synonymous with the paper sheet feed direction illustrated in FIG. 3 with reference character S marked) and an image is being formed on the recording surface of the paper sheet P.

The full-line ink-jet head is an ink-jet head having a structure in which a plurality of nozzles are arrayed along the nozzle array direction (illustrated in FIG. 3 with reference character M marked) perpendicular to the feed direction of the paper sheet P, over a length corresponding to the whole length of the paper sheet P in the nozzle array direction.

In the specification, the term "perpendicular" includes modes that exhibit a similar operation effect to the intersection at an angle of 90° and that can be regarded as being substantially perpendicular, of modes of the intersection at an angle of less than 90° or more than 90°.

The non-discharge correction means that, when a nozzle (recording element) not capable of discharging ink, or a non-discharge nozzle (defective recording element), which is a nozzle whose ink discharge operation has been stopped because of deviated flying or the like, is produced, the influence of the non-discharge is reduced by the ink discharge using a normal nozzle.

When there is a non-discharge nozzle in the ink-jet head 120, ink is not landed at the recording position corresponding to the non-discharge nozzle, and a white line along the feed direction of the paper sheet P is visually recognized in the drawn image.

For reducing the visibility of the white line by the production of the non-discharge nozzle, it is only necessary to increase the concentration of the ink to be discharged from the nozzles at both sides to the non-discharge nozzle. That is, as shown in FIG. 1, a greater concentration value than the concentration values of other nozzles is set to the nozzles (non-discharge correction nozzle (defect-compensation recording element)) at both sides to the non-discharge nozzle.

When a concentration value to be set to the non-discharge nozzle in the case where the non-discharge correction is not performed (a concentration value to be set to the nozzle in the case where the non-discharge correction nozzle does not function) is D, a concentration value to be set to the non-discharge correction nozzle in the case where the non-discharge correction is performed is m×D (m>1). Here, m is a non-discharge correction parameter (defective-recording-element compensation parameter) that determines the intensity of the non-discharge correction, and the value is set individually for each concentration value and for each correction-targeted non-discharge nozzle.

The process of altering the concentration value of the non-discharge correction nozzle using the non-discharge correction parameter and compensating the decrease in image quality by production of the non-discharge nozzle is referred to as the non-discharge correction.

First Embodiment

Next, a non-discharge correction parameter optimizing process according to a first embodiment of the present invention is described in detail.

<Explanation of Designated-Nozzle Fast Optimizing Process Flow>

Figure 2:
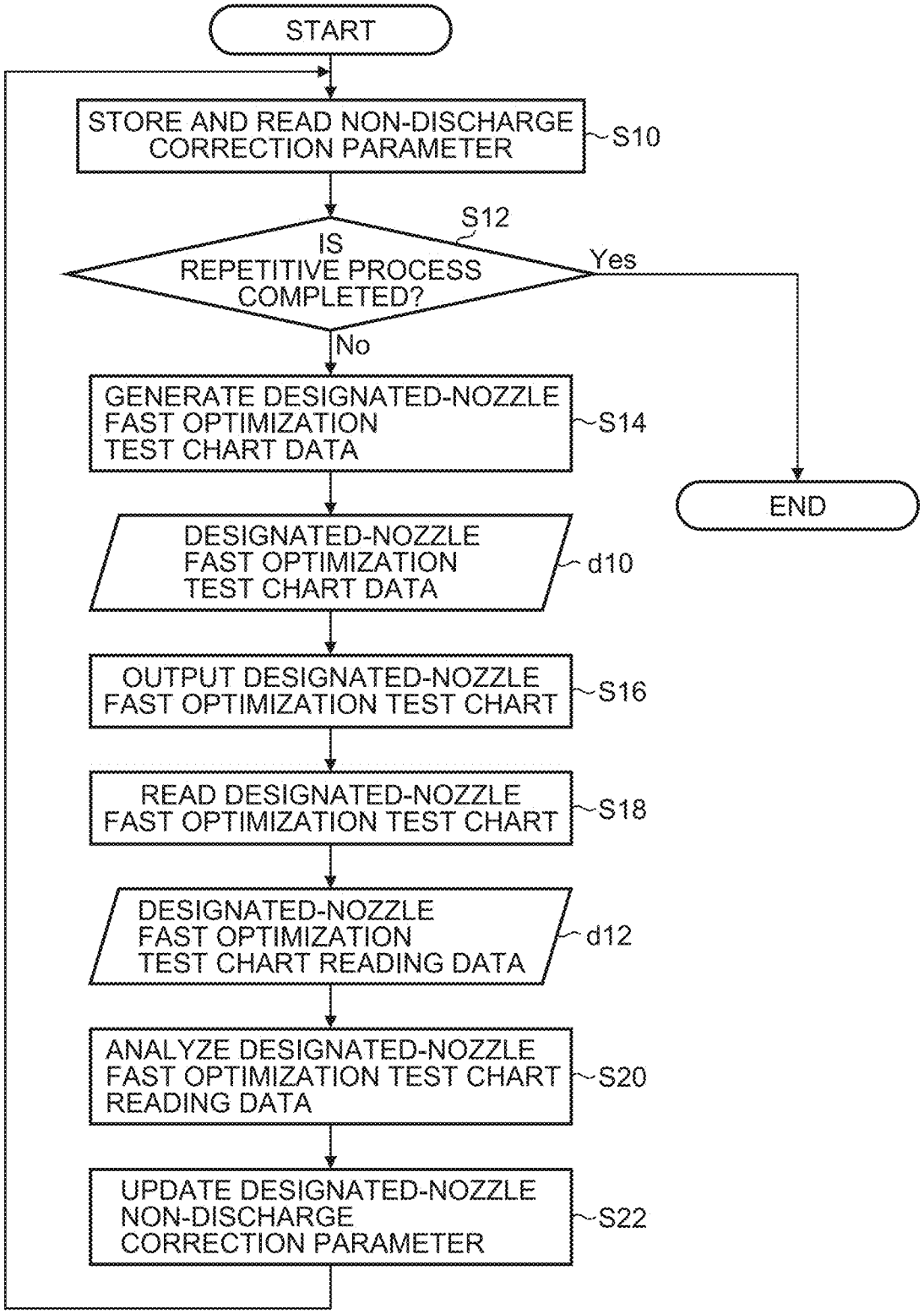
FIG. 2 is a flowchart showing the flow of a designated-nozzle fast optimizing process.

FIG. 2 is a flowchart showing the flow of a designated-nozzle fast optimizing process. The "designated-nozzle fast optimizing process" explained below is a process of fast optimizing the non-discharge correction parameter for the non-discharge nozzle of an optimized target.

In the example, a process of optimizing the non-discharge correction parameter for the non-discharge nozzle when the non-discharge nozzle is a designated nozzle is explained. Here, the "non-discharge correction parameter for the non-discharge nozzle" means the non-discharge correction parameter to be set to the non-discharge correction nozzle that performs the correction of the non-discharge nozzle. As the non-discharge correction nozzle, normal nozzles close to (for example, at both sides to) the non-discharge nozzle are applied.

In the following explanation, it is assumed to use a full-line type ink-jet head in which a plurality of nozzles are arrayed in a line, along the nozzle array direction (see FIG. 3) perpendicular to the feed direction (see FIG. 1) of the paper sheet P.

Further, it is assumed that the position of the non-discharge nozzle is previously grasped, and the non-discharge nozzle information, which contains the information of the position of the non-discharge nozzle, is acquired and stored. Moreover, it is assumed that the non-discharge correction nozzle is one of the nozzles at both sides to the non-discharge nozzle.

That is, when the nozzle number of the non-discharge nozzle is i (i is an integer of 1 or more), the i+1-th and i−1-th nozzles (in the case of i≠1) are the non-discharge correction nozzles. Here, the non-discharge correction nozzles may be a plurality of nozzles at both sides to the non-discharge nozzle, including the i+2-th nozzle and the i−2-th nozzle.

The non-discharge nozzle information is acquired and stored by the output of a non-discharge nozzle detection test chart, the reading of the non-discharge nozzle detection test chart with an optical reading apparatus, and the analysis of the reading result (reading data).

(Step S10: Non-Discharge Correction Parameter Reading Step)

The non-discharge correction parameter reading step shown in step S10 is a step of reading the latest non-discharge correction parameter that is previously stored and updated.

Figure 7:
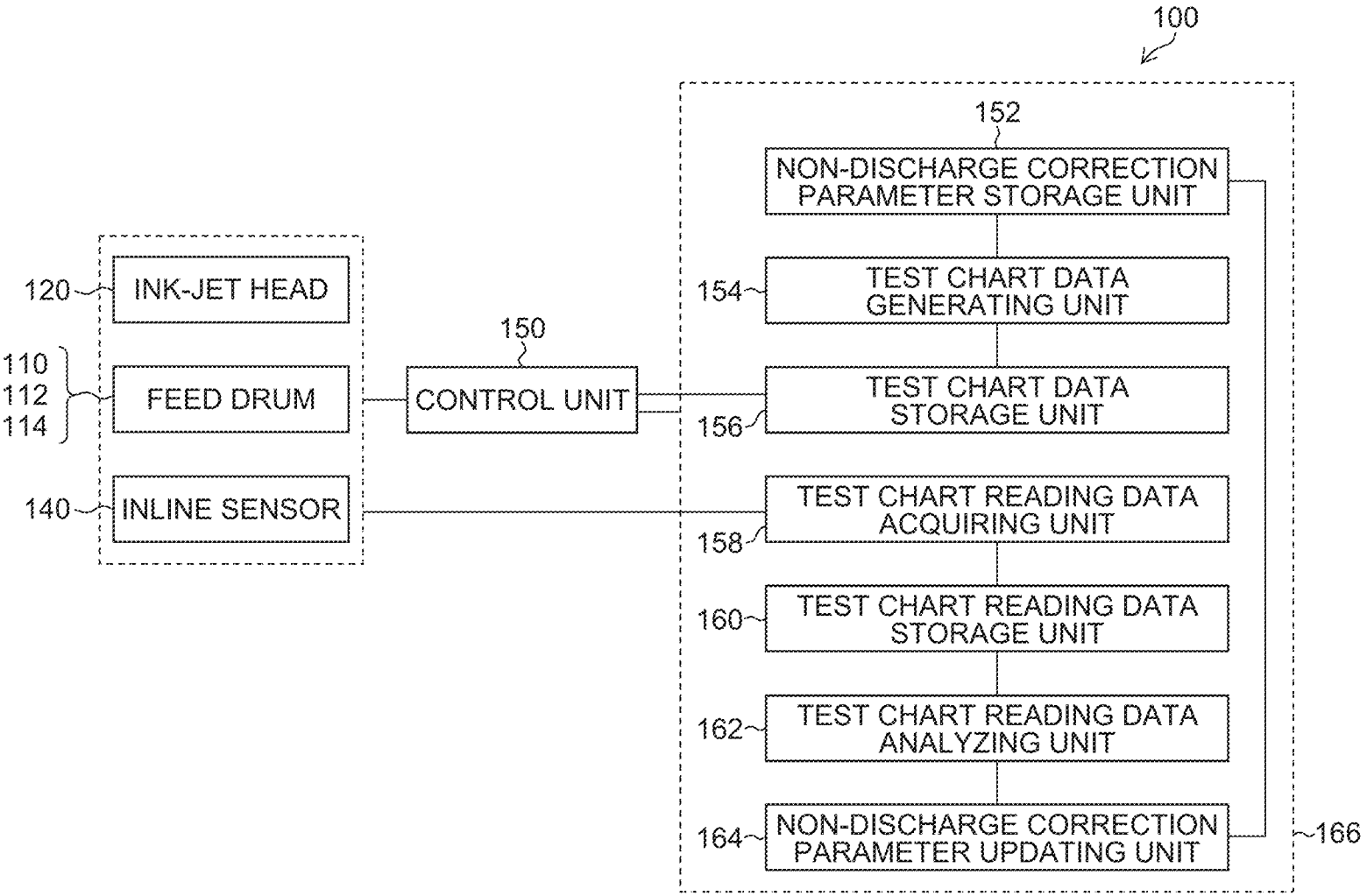
FIG. 7 is a block diagram of the ink-jet recording apparatus shown in FIG. 6.

In the ink-jet head before the start of use, the initial values of the non-discharge correction parameters are determined for all nozzles, and the initial values of the non-discharge correction parameters are stored in a previously determined storage unit (for example, a non-discharge correction parameter storage unit 152 in FIG. 7).

The discharge state of the ink-jet head is changed in association with the use, and therefore, as necessary, the non-discharge correction parameter for each nozzle is updated, for example, periodically, or when the decrease in image quality occurs by the production of the non-discharge nozzle.

(Step S12: Repetitive Process Completion Judging Step)

The repetitive process completion judging step shown in step S12 is a step of judging whether a repetitive process to optimize (update) the non-discharge correction parameter for the designated nozzle is completed. In the update of the non-discharge correction parameter for the designated nozzle, the respective steps of the generation of designated-nozzle fast optimization test chart data (step S14), the output of the designated-nozzle fast optimization test chart (step S16), the reading of the designated-nozzle fast optimization test chart (step S18), the analysis of designated-nozzle fast optimization test chart reading data (step S20), the update of the designated-nozzle non-discharge correction parameter (step S22), and the storing of the updated non-discharge correction parameter (step S10) are executed one or more times.

The number of times of the repetitive process to repeat the respective steps may be previously set, or may be appropriately determined based on the verification result of an image recorded by using the latest non-discharge correction parameter.

If the judgment that the repetitive process is completed (the non-discharge correction parameter has been optimized) (the Yes judgment in step S12) is made in the repetitive process completion judging step, the designated-nozzle fast optimizing process ends.

On the other hand, if the judgment that the repetitive process is not completed (the No judgment in step S12) is made in the repetitive process completion judging step, the flow proceeds to the designated-nozzle fast optimization test chart data generating step (step S14).

(Step S14: Designated-Nozzle Fast Optimization Test Chart Data Generating Step (Forming Step))

Figure 3:
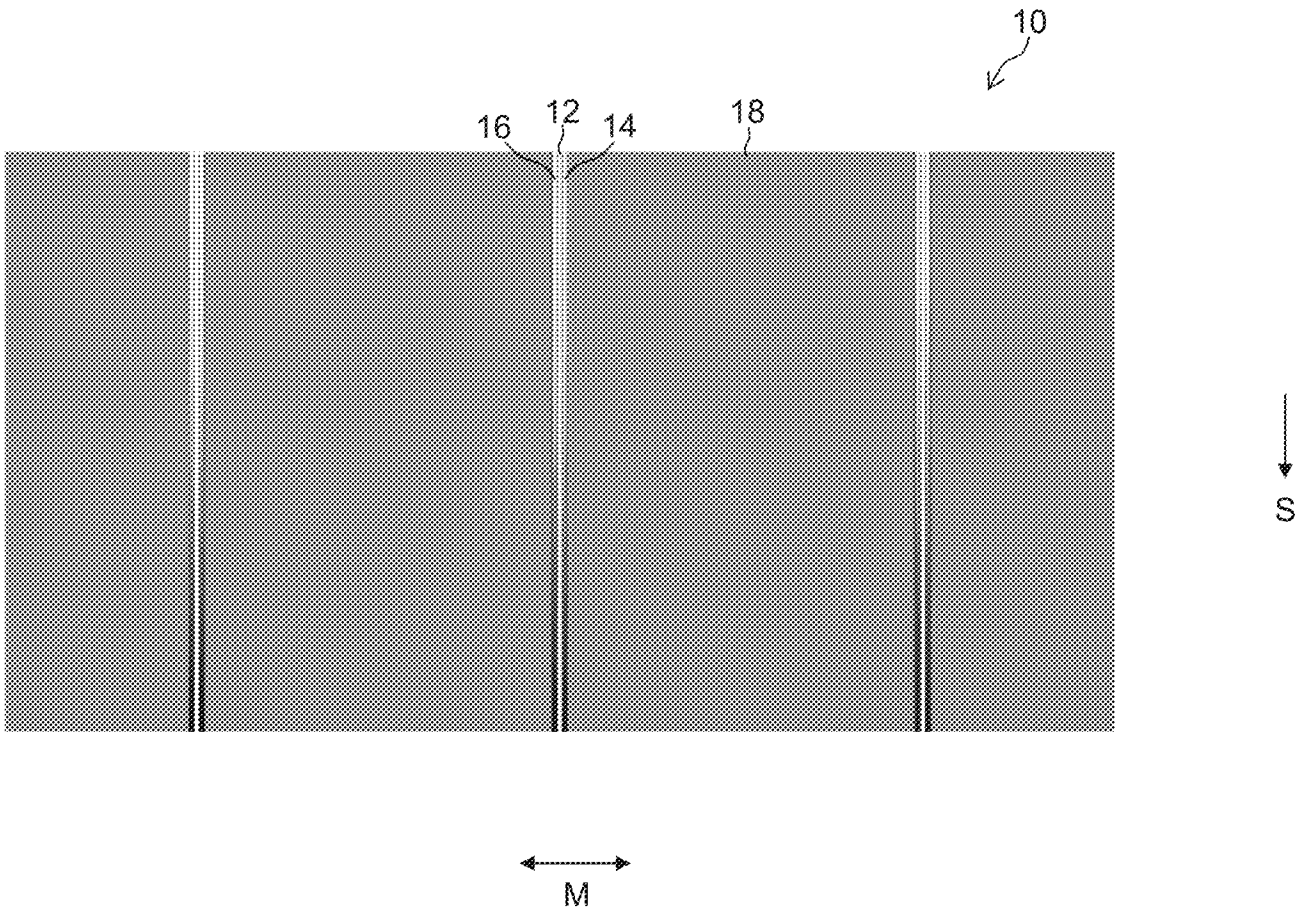
FIG. 3 is a schematic configuration diagram of a designated-nozzle fast optimization test chart.

In the designated-nozzle fast optimization test chart data generating step shown in step S14, designated-nozzle fast optimization test chart data (d10 in FIG. 2) that correspond to a designated-nozzle fast optimization test chart (first test chart) illustrated in FIG. 3 with reference character 10 marked are generated.

In the designated-nozzle fast optimization test chart data, the non-recording (m=0) is set to the non-discharge nozzle (designated nozzle), a plurality of non-discharge correction parameters varying continuously or intermittently are set to the non-discharge correction nozzles, and the latest non-discharge correction parameters are respectively set to out-of-processing-target nozzles other than the non-discharge nozzle and the non-discharge correction nozzles.

As for the designation of the designated nozzle, the non-discharge nozzle may be automatically designated as the designated nozzle, based on the non-discharge nozzle information, or an operator may manually designate the designated nozzle. The designation of the designated nozzle only has to be performed before the designated-nozzle fast optimization test chart data generating step.

(Step S16: Designated-Nozzle Fast Optimization Test Chart Outputting Step (Forming Step))

After the designated-nozzle fast optimization test chart data are generated in the designated-nozzle fast optimization test chart data generating step shown in step S14, the designated-nozzle fast optimization test chart is output. The designated-nozzle fast optimization test chart is output on the paper sheet P, using the ink-jet head 120 (see FIG. 1).

In the output of the designated-nozzle fast optimization test chart, it is preferable that the recovery operation of the ink-jet head 120 is executed and the discharge state (recording state) of each nozzle of the ink-jet head 120 is kept constant.

(Step 18: Designated-Nozzle Fast Optimization Test Chart Reading Step (Reading Step))

The designated-nozzle fast optimization test chart output on the paper sheet P is read using a reading apparatus such as an inline sensor (illustrated in FIG. 6 with reference numeral 140 marked), so that designated-nozzle fast optimization test chart reading data (d12) are obtained. In the reading of the designated-nozzle fast optimization test chart, an external apparatus such as a flatbed scanner may be used.

(Step S20: Designated-Nozzle Fast Optimization Test Chart Analyzing Step (Analyzing Step))

After the designated-nozzle fast optimization test chart reading data are acquired in the designated-nozzle fast optimization test chart reading step, the designated-nozzle fast optimization test chart reading data are analyzed (the detail is described later).

(Step S22: Designated-Nozzle Non-Discharge Correction Parameter Updating Step (Analyzing Step))

The non-discharge correction parameter for the designated nozzle is updated based on the analysis result in the designated-nozzle fast optimization test chart analyzing step. The updated non-discharge correction parameter is stored in a previously determined storage unit (for example, the non-discharge correction parameter storage unit 152 in FIG. 7) (the non-discharge correction parameter storing step in step S10).

<Explanation of Designated-Nozzle Fast Optimization Test Chart>

FIG. 3 is a schematic configuration diagram of a designated-nozzle fast optimization test chart that is applied to the designated-nozzle fast optimizing process. A designated-nozzle fast optimization test chart 10 shown in the figure is configured by non-recording regions 12, measurement chart regions 14, 16 and uniform concentration regions 18.

The non-recording region 12 is a region of non-recording where the recording is not performed, and has a width (a length in the nozzle array direction M) equivalent to one nozzle and parallel to the paper sheet feed direction S, at the position corresponding to the recording position of the non-discharge nozzle. The designated-nozzle fast optimization test chart 10 illustrated in FIG. 3 has three non-recording regions 12.

The measurement chart regions 14, 16 are charts in which the non-discharge correction parameter is successively assigned from weakness (white line) to strength (block line), and measurement charts having a width equivalent to the number of non-discharge correction nozzles and parallel to the paper sheet feed direction S are formed at the positions corresponding to the recording positions of the non-discharge correction nozzles.

The designated-nozzle fast optimization test chart 10 shown in FIG. 3 has the measurement chart region 14 with a width equivalent to one nozzle, at one side (the right side in FIG. 3) to each non-recording region 12. The measurement chart region 16 with a width equivalent to one nozzle is formed at the other side (the left side in FIG. 3) to each non-recording region 12.

At the measurement chart regions 14, 16 formed at both sides across the non-recording region 12, measurement charts with an identical content based on identical data are formed.

As the range of the non-discharge correction parameter to be applied to the measurement charts at the measurement chart regions 14, 16, the whole range from the maximum value to the minimum value may be applied, or a part of the whole range may be applied. As described later, in the case where the designated-nozzle fast optimizing process is repetitively executed multiple times, the range of the non-discharge correction parameter may be narrowed as the number of processing increases.

The uniform concentration region 18, at which a solid pattern having a uniform concentration of a previously determined processing-target concentration value is formed, corresponds to the recording positions of the out-of-processing-target nozzles except the non-discharge nozzles and the non-discharge correction nozzles.

That is, in the designated-nozzle fast optimization test chart 10, the white line is formed at the non-recording region 12 corresponding to the recording position of the non-discharge nozzle, the measurement charts in which the plurality of non-discharge correction parameters vary continuously or intermittently (having a structure of the division for each concentration value, in which the concentration value varies from shade to light continuously or intermittently) are formed at both sides (the measurement chart regions 14, 16) to the white line at the non-recording region 12, and the uniform concentration (solid) pattern having a uniform concentration is formed at the uniform concentration region 18 between the measurement chart regions 14, 16.

In the measurement charts formed at the measurement chart regions 14, 16 shown in FIG. 3, the non-discharge feed parameter (the concentration value indicated by each sub-region configuring the measurement chart) decreases from the downstream side to the upstream side in the paper sheet feed direction S. The maximum value of the non-discharge correction parameter is applied at the downmost stream position in the paper sheet feed direction S, and the minimum value of the non-discharge correction parameter is applied at the upmost stream position in the same direction.

Figure 4:
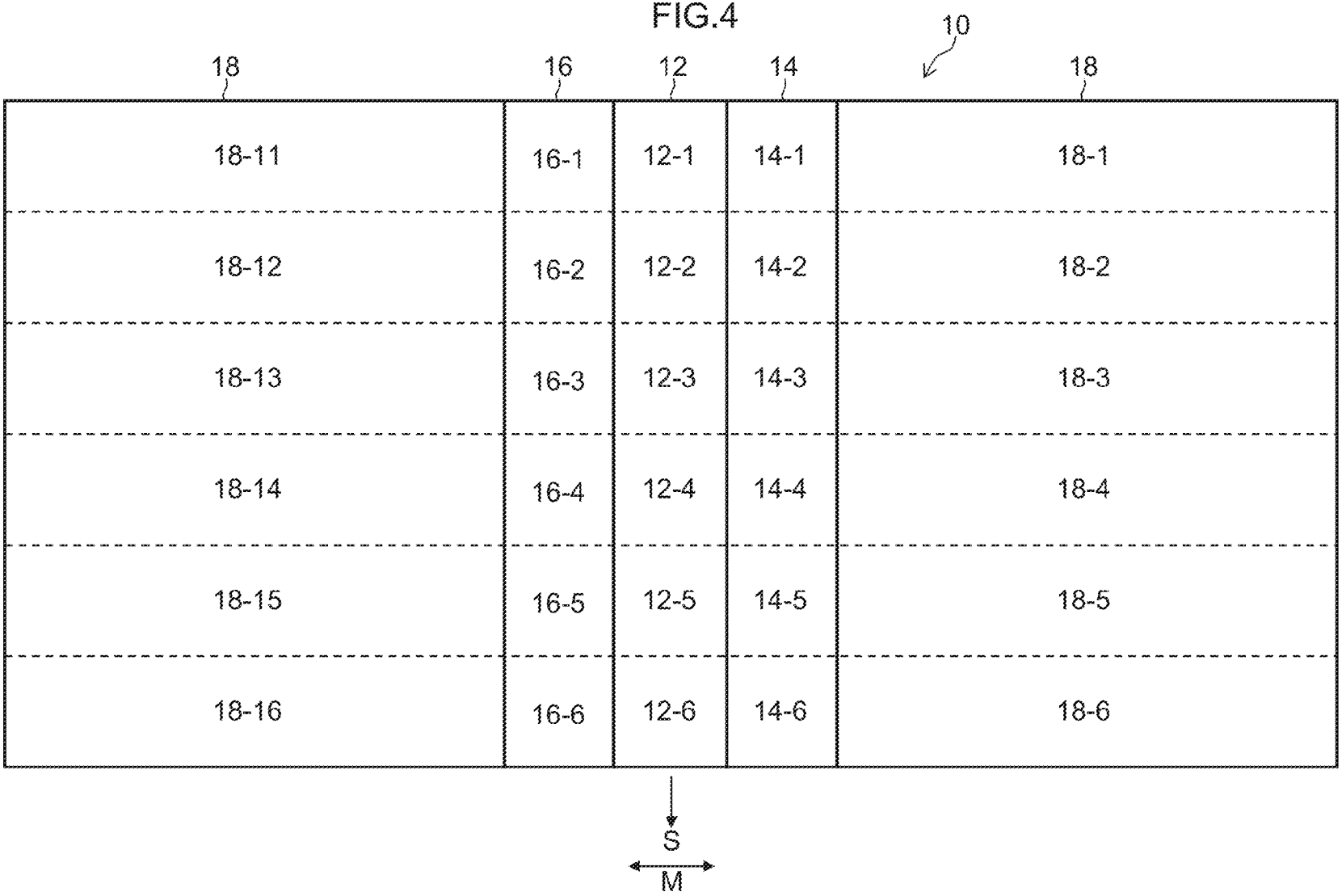
FIG. 4 is a partial enlarged diagram that schematically illustrates a part of the designated-nozzle fast optimization test chart illustrated in FIG. 3.

FIG. 4 is a partial enlarged diagram of the designated-nozzle fast optimization test chart illustrated in FIG. 3, and schematically illustrates the detailed configuration of the designated-nozzle fast optimization test chart. Here, for convenience sake, the non-recording region 12 and the uniform concentration region 18 are divided into a plurality of regions in the paper sheet feed direction S (illustrated by broken lines), corresponding to the divisions (sub-regions) of the measurement chart regions 14, 16.

As for six non-discharge correction parameters $m_a$, $m_b$, $m_c$, $m_d$, $m_e$ and $m_f$ ($m_a<m_b<m_c<m_d<m_e<m_f$), the non-discharge correction parameter $m_a$ is applied to the sub-regions to which reference numerals 14-1, 16-1 are marked, the non-discharge correction parameter $m_b$ is applied to the sub-regions to which reference numerals 14-2, 16-2 are marked, the non-discharge correction parameter $m_c$ is applied to the sub-regions to which reference numerals 14-3, 16-3 are marked, the non-discharge correction parameter $m_d$ is applied to the sub-regions to which reference numerals 14-4, 16-4 are marked, the non-discharge correction parameter $m_e$ is applied to the sub-regions to which reference numerals 14-5, 16-5 are marked, and the non-discharge correction parameter $m_f$ is applied to the sub-regions to which reference numerals 14-6, 16-6 are marked.

Then, the sub-regions 14-1 to 14-6 and 16-1 to 16-6 are closely formed in the paper sheet feed direction S, without providing gaps. By closing the sub-regions without providing gaps between the sub-regions, it is possible to prevent the generation of the reading data errors caused by the reflection by the white background of the gaps, when the measurement chart is read using an optical reading apparatus.

The lengths in the paper sheet feed direction S of the sub-regions of the measurement chart regions 14, 16 illustrated in FIG. 4 are determined in consideration of the reading length in the same direction of the reading apparatus, the number of regions (the number of non-discharge correction parameters) and the performance of the reading apparatus (the scan period, the signal output period and the like).

<Explanation of Analysis of Designated-Nozzle Fast Optimization Test Chart Reading Data>

The designated-nozzle fast optimization test chart 10 illustrated in FIG. 3 and FIG. 4 is read by an optical reading apparatus (for example, the inline sensor 140 in FIG. 6), and the designated-nozzle fast optimization test chart reading data are output from the reading apparatus.

The acquired designated-nozzle fast optimization test chart reading data are analyzed, and the optimum value of the non-discharge correction parameter is decided.

That is, a sub-region having a concentration equivalent to the concentration at the uniform concentration region 18 in the vicinity is searched from the sub-regions in the measurement charts formed at the measurement chart regions 14, 16, and a non-discharge correction parameter given at the sub-region meeting this condition is decided as the optimum value of the non-discharge correction parameter for the processing target concentration value.

In other words, candidate values of the optimum value of the non-discharge correction parameter are given at the measurement chart regions 14, 16, and the measurement chart that is composed of the plurality of sub-regions and in which the concentration value varies continuously or intermittently is formed at the measurement chart regions 14, 16. From the plurality of candidate values, a non-discharge correction parameter to actualize a concentration value closest to the concentration value (the processing target concentration value) at the uniform concentration region 18 is decided as the optimum value.

For example, as the evaluation function (evaluation index) of the optimum value of the non-discharge correction parameter, the difference between the average concentration at target non-discharge roughly-vicinal regions except target non-discharge extremely-vicinal regions and the target non-discharge extremely-vicinal regions at which the non-discharge correction parameter is given is possible.

The "target non-discharge extremely-vicinal regions" are regions in which the branch numbers (the numerical values following the hyphens) for the non-recording region 12 and the measurement chart regions 14, 16 in FIG. 4 match. The "target non-discharge roughly-vicinal regions" are regions of the uniform concentration regions 18 in which the last-digit numerical values of the branch numbers of the target non-discharge extremely-vicinal regions match with the numerical values of the branch numbers of the target non-discharge extremely-vicinal regions.

That is, the "target non-discharge extremely-vicinal regions" are the sub-regions 14-1, 16-1 of the measurement chart regions 14, 16 where the non-discharge correction parameter $m_a$ is given, and the virtual sub-region 12-1 of the non-recording region corresponding to the sub-regions 14-1, 16-1 of the measurement chart regions 14, 16.

Then, the "target non-discharge roughly-vicinal region", which is the comparison target of the "target non-discharge extremely-vicinal regions", is at least one of the sub-region 18-1 and sub-region 18-11 by the division for convenience sake.

In the designated-nozzle fast optimization test chart shown in FIG. 4, the difference value ($D_{ave1}-D_{ave11}$) between the average concentration $D_{ave1}$ of the regions 12-1, 14-1, 16-1 as the target non-discharge extremely-vicinal regions and the average concentration $D_{ave11}$ of the regions 18-1, 18-11 as the target non-discharge roughly-vicinal region is determined. Similarly, the difference value ($D_{ave2}-D_{ave12}$) between the average concentration $D_{ave2}$ of the regions 12-2, 14-2, 16-2 and the average concentration $D_{ave12}$ of the regions 18-2, 18-12 is determined, . . . , and the difference value ($D_{ave6}-D_{ave16}$) between the average concentration $D_{ave6}$ of the regions 12-6, 14-6, 16-6 as the target non-discharge extremely-vicinal regions and the average concentration $D_{ave16}$ of the regions 18-6, 18-16 as the target non-discharge roughly-vicinal region is determined.

Then, a non-discharge correction parameter given for a combination of the target non-discharge extremely-vicinal region and the target non-discharge roughly-vicinal region that minimizes the determined difference value is judged as the optimum value of the non-discharge correction parameter for the in-question concentration, and is set as the update value of the designated-nozzle non-discharge correction parameter.

According to the optimizing method for the designated-nozzle non-discharge correction parameter shown in the example, since the target of the optimization of the non-discharge correction parameter is limited to the designated nozzle, the number of processing steps and the processing time are drastically reduced, compared to the case of optimizing the non-discharge correction parameters for all nozzles.

Further, it is possible to optimize the non-discharge correction parameter for the designated nozzle, using the designated-nozzle fast optimization test chart 10 formed on a single paper sheet, and it is possible to shorten the output time of the test chart, compared to a scheme of optimizing the non-discharge correction parameter by outputting multiple sheets of test charts based on a single-variable root-finding algorithm, allowing for the reduction of the number of paper sheets to be used for the test chart.

In the example, corresponding to the division in the paper sheet feed direction S of the target non-discharge extremely-vicinal regions (the measurement chart regions 14, 16), the uniform concentration region 18 is divided in the same direction as the target non-discharge roughly-vicinal regions. However, the whole or a part of the uniform concentration region 18 may be the target non-discharge roughly-vicinal regions, without dividing the uniform concentration region 18 in the paper sheet feed direction S.

On the other hand, as shown in FIG. 4, corresponding to the division in the paper sheet feed direction S of the target non-discharge extremely-vicinal regions (the measurement chart regions 14, 16), the uniform concentration region 18 is divided in the same direction as the target non-discharge roughly-vicinal regions, and thereby, it is possible to optimize the designated-nozzle non-discharge correction parameter without being influenced by the change in the paper sheet feed speed in the paper sheet feed direction S, the variability in the discharge properties of the nozzles in the same direction, or the like.

Further, the length of the target non-discharge roughly-vicinal region in the nozzle array direction M may be a recording width equivalent to one nozzle. However, in the case of a recording width equivalent to several nozzles, it is possible to inhibit the influence of the variability in the discharge properties of the nozzles, or the like. The target non-discharge roughly-vicinal region may be a region along the paper sheet feed direction S.

In the example, the mode in which the designated nozzle is a non-discharge nozzle has been exemplified. However, also, in the case where the designated nozzle is a normal nozzle and a nozzle near the designated nozzle (for example, a nozzle adjacent to the designated nozzle) is a non-discharge nozzle, it is possible to optimize the non-discharge correction parameter for the designated nozzle.

In the case where the designated nozzle is a normal nozzle, the recording position of the designated nozzle is the measurement chart region 14 or measurement chart region 16 in FIG. 3, a nozzle for which the designated nozzle performs the correction is a simulated non-discharge nozzle, and the non-recording is provided at the recording position of the simulated non-discharged nozzle. Moreover, the recording position of a nozzle at the opposite side to the designated nozzle with respect to the simulated non-discharge nozzle may be the measurement chart region 16 in FIG. 3 (or the measurement chart region 14).

Then, assuming that the sub-regions of the measurement chart regions 14, 16 and the convenient sub-regions of the non-recording region 12 are the "target non-discharge extremely-vicinal regions" and the vicinities of the "target non-discharge extremely-vicinal regions" in the uniform concentration region 18 are the "target non-discharge roughly-vicinal regions", the above optimizing scheme may be applied.

<Application Example of Designated-Nozzle Fast Optimizing Process>

Figure 5:
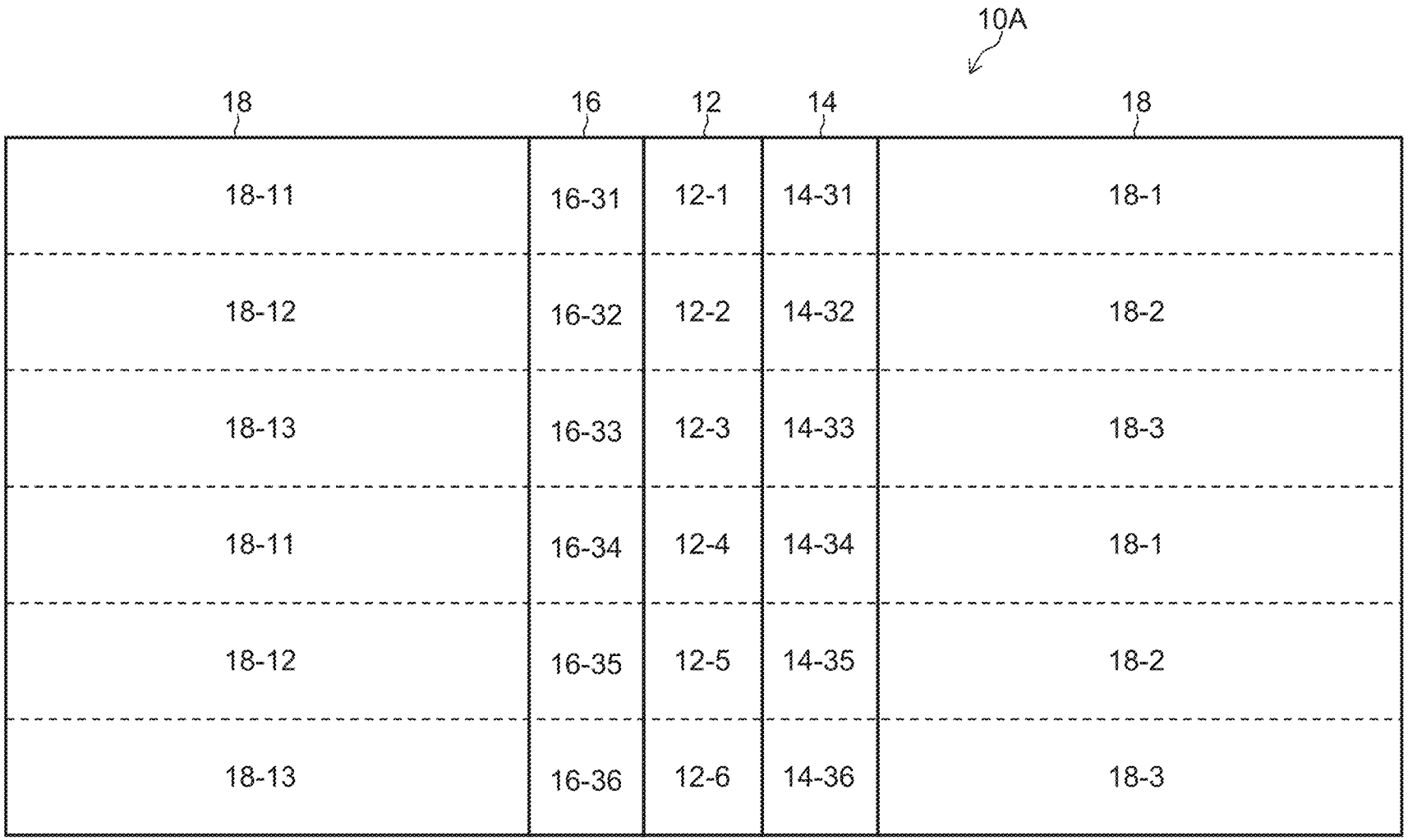
FIG. 5 is a schematic configuration diagram of a designated-nozzle fast optimization test chart that is applied to an application example of the embodiment.

Next, an application example of the above explained designated-nozzle fast optimizing process is explained. FIG. 5 is a schematic configuration diagram of a designated-nozzle fast optimization test chart 10A according to the application example. In FIG. 5, for identical or similar parts to FIG. 3 and FIG. 4, identical reference numerals are marked, and the explanations are omitted.

When the above designated-nozzle fast optimizing process is repeated multiple times, the non-discharge correction parameter for the designated nozzle can be a more appropriate value. In the multiple-time repetitive process, it is effective to narrow the assigning width of the non-discharge correction parameter that is given for the non-discharge correction nozzle (to narrow down the range).

For example, when, in the last-time (first-time) process, $m_c$ is determined as the optimum value of the non-discharge correction parameter, $m_{c1}$, $m_{c2}$, $m_{c3}$, $m_{c4}$, $m_{c5}$ and $m_{c6}$ (here, $m_{c1}$, $m_{c2}$, $m_{c3}$, $m_{c4}$, $m_{c5}$ and $m_{c6}$ are $m_b$ or more and $m_d$ or less) are set as non-discharge correction parameters to be applied in the current-time (second-time) process.

In the designated-nozzle fast optimization test chart 10A shown in FIG. 5, the non-discharge correction parameter $m_{c1}$ is given at sub-regions 14-31, 16-31 of the measurement chart regions 14, 16. Similarly, the non-discharge correction parameter $m_{c2}$ is given at sub-regions 14-32, 16-32, the non-discharge correction parameter $m_{c3}$ is given at sub-regions 14-33, 16-33, the non-discharge correction parameter $m_{c4}$ is given at sub-regions 14-34, 16-34, the non-discharge correction parameter $m_{c5}$ is given at sub-regions 14-35, 16-35, and the non-discharge correction parameter $m_{c6}$ is given at sub-regions 14-36, 16-36.

Then, the difference value ($D_{ave31}-D_{ave11}$) between the average concentration $D_{ave31}$ of the regions 12-1, 14-31, 16-31 as the target non-discharge extremely-vicinal regions and the average concentration $D_{ave11}$ of the regions 18-1, 18-11 as the target non-discharge roughly-vicinal region, . . . , and the difference value ($D_{ave36}-D_{ave16}$) between the average concentration $D_{ave36}$ of the regions 12-6, 14-36, 16-36 as the target non-discharge extremely-vicinal regions and the average concentration $D_{ave16}$ of the regions 18-6, 18-16 as the target non-discharge roughly-vicinal region are determined.

Then, a non-discharge correction parameter given for a combination of the target non-discharge extremely-vicinal region and the target non-discharge roughly-vicinal region that minimizes the determined difference value is judged as the optimum value of the non-discharge correction parameter for the in-question concentration, and is set as the update value of the designated-nozzle non-discharge correction parameter. Here, the ratio of the average concentration of the target non-discharge extremely-vicinal regions to the average concentration of the target non-discharge roughly-vicinal regions may be determined instead of the difference value, and a value of the ratio closest to "1" may be the optimum value of the non-discharge correction parameter for the in-question concentration. That is, the optimum value of the non-discharge correction parameter is determined based on the concentration difference between the target non-discharge roughly-vicinal region and the target non-discharge extremely-vicinal region.

Thus, by narrowing down the value of the non-discharge correction parameter to be given for the designated nozzle whenever the number of processing increases, it is possible to narrow down the optimum value of the non-discharge correction parameter.

Although the width (the number of nozzles) of the target non-discharge roughly-vicinal region in the nozzle array direction only has to be a recording width (one nozzle) for at least one nozzle, it is preferable to be a recording width (two or more nozzles) for a plurality of nozzles, in view of the unevenness of the concentration. Further, the width of the target non-discharge roughly-vicinal region in the nozzle array direction is determined depending on the operation condition such as the capacity of the operation region, the capacity of the storage region and the operation speed.

<Application Example for Apparatus>

Figure 6:
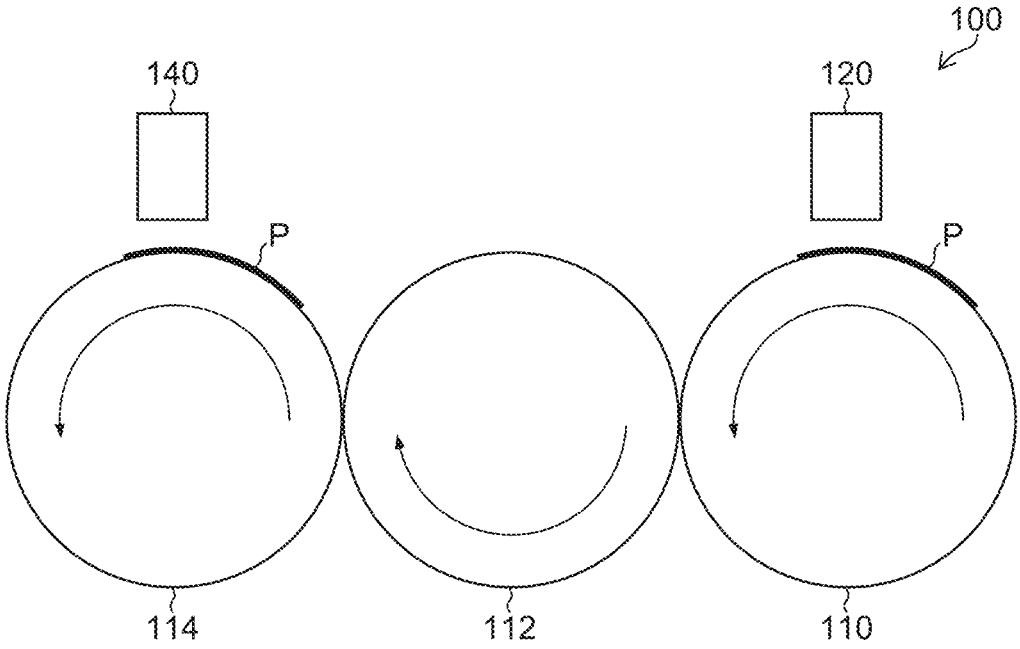
FIG. 6 is an overall configuration diagram of an ink-jet recording apparatus to which a non-discharge correction parameter optimizing process according to the present invention is applied.

FIG. 6 is an overall configuration diagram of an ink-jet recording apparatus (image recording apparatus) to which the non-discharge correction parameter optimizing process according to the present invention is applied. Here, in the following explanation, the above "designated-nozzle fast optimization test charts 10, 10A" are sometimes referred to as merely "test charts".

An ink-jet recording apparatus 100 shown in the figure, which is a single-pass-method line printer to form an image on the recording surface of the paper sheet P, includes feed drums 110, 112, 114, an ink-jet head 120 (forming device), an inline sensor 140 (reading device) and the like.

On the feed surfaces of the feed drums 110, 112, 114, many adsorption holes (not shown in the figure) are formed in a predetermined pattern. The paper sheet P wound on the peripheral surfaces of the feed drums 110, 112, 114 is adsorbed from the adsorption holes, and thereby, is fed while being adsorbed and held on the peripheral surfaces of the feed drums 110, 112, 114.

On the opposing surface of the ink-jet head 120 to the feed drum 110, a plurality of nozzles (not shown in FIG. 6, but, shown in FIGS. 17A and 17B with reference numeral 51 marked) are formed over the whole width of the paper sheet P. By the control of a control unit, the ink-jet head 120 discharges ink from the respective nozzles and forms an image on the recording surface of the paper sheet P that is fed by the feed drum 110. Thus, a one-time feed (single pass) by the feed drum 110 forms an image on the whole surface of the recording surface of the paper sheet P.

The paper sheet P on which the image has been formed on the recording surface by the ink-jet head 120 is transferred from the feed drum 110 to the feed drum 112, and further is transferred from the feed drum 112 to the feed drum 114.

The image formed on the recording surface of the paper sheet P that is adsorbed and held on the feed drum 114 is picked up by the inline sensor 140.

The inline sensor 140 is a device that reads the image formed on the paper sheet P and detects the concentration of the image, the impact position deviation for dots, and the like, and a CCD line sensor or the like is applied.

Here, the feed drum 112 only needs to transfer the paper sheet P from the feed drum 110 to the feed drum 114, and does not need to adsorb and hold the whole surface of the paper sheet P. Therefore, the feed drum 112 may be a transfer cylinder that includes a gripper to grip the edge of the paper sheet P and that is configured by a cylindrical frame.

FIG. 7 is a block diagram of the ink-jet recording apparatus 100 shown in FIG. 6. In addition to the feed drums 110, 112, 114, the ink-jet head 120, the inline sensor 140 and the control unit 150 to perform the integrated control of the units of the apparatus, the ink-jet recording apparatus 100 includes a non-discharge correction parameter optimizing unit 166 (defective-recording-element compensation parameter optimizing apparatus) that is constituted by a non-discharge correction parameter storage unit 152, a test chart data generating unit 154, a test chart data storage unit 156, a test chart reading data acquiring unit 158, a test chart reading data storage unit 160, a test chart reading data analyzing unit 162 (analyzing device), a non-discharge correction parameter updating unit 164 (analyzing device) and the like.

In the non-discharge correction parameter storage unit 152, the non-discharge correction parameter is stored for each nozzle of all the nozzles of the ink-jet head 120. At least the latest non-discharge correction parameter is stored in the non-discharge correction parameter storage unit 152.

The test chart data generating unit 154 generates the test chart data (designated-nozzle fast optimization test chart data (d10)) for optimizing the non-discharge correction parameter, based on the latest non-discharge correction parameter read from the non-discharge correction parameter storage unit 152. The test chart data generated by the test chart data generating unit 154 are stored in the test chart data storage unit 156.

The control unit 150 reads the test chart data from the test chart data storage unit 156, generates a drive voltage based on the test chart data, and supplies the drive voltage to the ink-jet head 120.

The ink-jet head 120 discharges ink from each nozzle based on the drive voltage, and records the test chart (designated-nozzle fast optimization test chart 10 or 10A) on the recording surface of the paper sheet P that is fed by the feed drum 110.

That is, the control unit 150 illustrated in FIG. 7 functions as a memory controller that controls the data writing and reading in the respective storage units (memories) such as the non-discharge correction parameter storage unit 152 and the test chart data storage unit 156, functions as a drive voltage generating unit that generates the drive voltage to be supplied to the ink-jet head 120, and functions as a drive voltage supplying unit that supplies (outputs) the drive voltage to the ink-jet head 120.

Here, it is preferable to form the test charts individually for the respective colors. The plurality of test charts for the respective colors may be formed on one paper sheet, or the plurality of test charts for the respective colors may be formed on a plurality of paper sheets P.

The paper sheet P on which the test chart has been recorded is fed from the feed drum 110 to the feed drums 112, 114, and the test chart is read by the inline sensor 140. The inline sensor 140 reads the test chart recorded on the paper sheet P, and generates the test chart reading data. The test chart reading data read by the inline sensor 140 are stored in the test chart reading data storage unit 160 through the test chart reading data acquiring unit 158.

The test chart reading data analyzing unit 162 analyzes the test chart reading data stored in the test chart reading data storage unit 160, and decides (searches) the optimum value of the non-discharge correction parameter.

The non-discharge correction parameter updating unit 164 stores, in the non-discharge correction parameter storage unit 152, the optimum value of the non-discharge correction parameter decided (searched) by the test chart reading data analyzing unit 162, as the latest (updated) non-discharge correction parameter.

Also, the utilization of a part or whole of the function of the ink-jet recording apparatus 100 illustrated in FIG. 7 allows for the function as an image processing apparatus (defective-recording-element compensation parameter optimizing apparatus) to optimize the non-discharge correction parameter for the non-discharge correction nozzle that performs the correction of the non-discharge nozzle.

In the case of optimizing the non-discharge correction parameter for the designated nozzle that is previously designated, the designated-nozzle fast optimizing process and ink-jet recording apparatus configured as described above forms the measurement chart in which the non-recording is provided at the non-recording region 12, which is the recording position of the non-discharge nozzle as the designated nozzle, and the non-discharge correction parameter is successively assigned from weakness to strength at the measurement chart regions 14, 16, which are the recording positions of the non-discharge correction nozzles, such that a plurality of non-discharge correction parameters vary continuously or intermittently.

The non-discharge correction parameter minimizing the difference value between the average concentration at the target non-discharge extremely-vicinal regions for the respective non-discharge correction parameters and the average concentration at the target non-discharge roughly-vicinal regions corresponding to the target non-discharge extremely-vicinal regions is the optimum value of the non-discharge correction parameter, and is stored as the latest non-discharge correction parameter for the designated nozzle.

Therefore, the non-discharge correction parameter for the designated nozzle is efficiently optimized, compared to a scheme of optimizing the non-discharge correction parameter based on a single-variable root-finding algorithm. Further, it is possible to output the designated-nozzle fast optimization test chart 10 (designated-nozzle fast optimization test chart 10A) on a single paper sheet, without outputting multiple sheets of test charts based on the single-variable root-finding algorithm, resulting in a contribution to the reduction of paper sheets to be used.

In the example, the ink-jet recording apparatus has been exemplified as an example of the image recording apparatus. However, as for the range of application, the present invention can be widely applied to image recording apparatuses having recording elements, such as an image recording apparatus by an electrophotographic method.

Further, a program to implement, in a computer, the function of each unit of the non-discharge correction parameter optimizing unit 166 illustrated in FIG. 7 can be configured as an operation program for a central processing unit (CPU) incorporated in a printer or the like, or can be configured as the computer system of a personal computer.

Such a processing program can be stored in an information storage medium (a CD-ROM, a magnetic disc or the like) or an external storage device, and the program can be provided to a third person through the information storage medium. Further, the program can be provided as a download service through a communication line, or can be provided as an APS (Application Service Provider) service.

The inline sensor 140 shown in FIG. 7 may be an inline sensor that includes color separation filters such as RGB color filters and can acquire the color information of a reading target image, or may be a monochrome-compliant inline filter.

Second Embodiment

Next, a second embodiment of the present invention is explained. As described below, a non-discharge correction parameter optimizing method and apparatus according to the second embodiment utilize the non-discharge correction parameter fast optimizing process targeting the designated nozzle explained in the first embodiment, and optimizes the non-discharge correction parameter, targeting all nozzles, in consideration of an already-known non-discharge nozzle.

<Explanation of All-Nozzle Optimizing Process>

Figure 8:
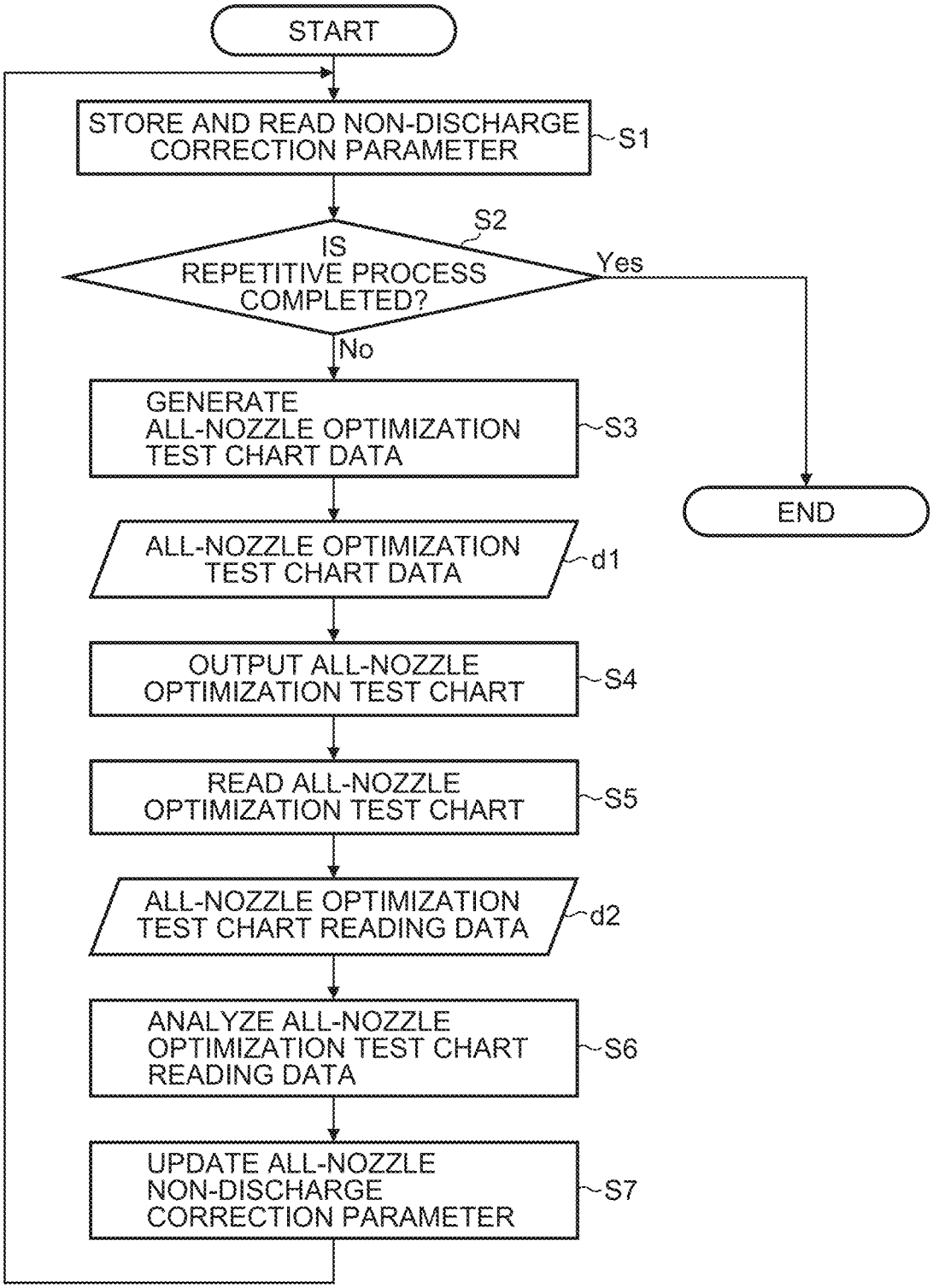
FIG. 8 is a flowchart showing the flow of an all-nozzle optimizing process when a non-discharge nozzle does not exist.

First, an all-nozzle optimizing process when a non-discharge does not exist is explained. FIG. 8 is a flowchart showing the flow of the all-nozzle optimizing process. In the following explanation, as for contents in common with the designated-nozzle optimizing process according to the first embodiment, the descriptions are omitted.

Here, the apparatus configuration in the following explanation corresponds to each unit of the ink-jet recording apparatus 100 illustrated in FIG. 7.

(Step S1: Non-Discharge Correction Parameter Reading Step)

In the non-discharge correction parameter reading step shown in step S1, the non-discharge correction parameter stored previously is read.

(Step S2: Repetitive Process Completion Judging Step)

In the repetitive process completion judging step shown in step S2, whether a repetitive process in the optimization (update) of the non-discharge correction parameter is completed is judged. In the update of the non-discharge correction parameter, the respective steps of the production of all-nozzle optimization test chart data (d1) (step S3), the output of an all-nozzle optimization test chart (second test chart) (step S4), the reading of the all-nozzle optimization test chart (step S5), the analysis of all-nozzle optimization reading data (d2) (step S6), the update of the all-nozzle non-discharge correction parameter (step S7) and the storing of the updated non-discharge correction parameter (step S1) are executed one or more times.

If the judgment that the above repetitive process is completed (the Yes judgment in step S2) is made, all processes end because the non-discharge correction parameters for all nozzles have been optimized. On the other hand, if the judgment that the repetitive process is not completed (the No judgment in step S2) is made, the flow proceeds to step S3.

(Step S3: All-Nozzle Optimization Test Chart Data Generating Step)

The test chart data generating unit 154 (see FIG. 7) reads the non-discharge correction parameter for each nozzle of all the nozzles from the non-discharge correction parameter storage unit 152, and generates the all-nozzle optimization test chart data (d1).

(Step S4: All-Nozzle Optimization Test Chart Outputting Step)

The all-nozzle optimization test chart data generated by the test chart data generating unit 154 (see FIG. 7) are stored in the test chart data storage unit 156. The control unit 150 reads the all-nozzle optimization test chart data stored in the test chart data storage unit 156, controls each nozzle of the ink-jet head 120 based on the all-nozzle optimization test chart data, and outputs the all-nozzle optimization test chart (illustrated in FIG. 9 with reference numeral 1 marked) on the recording surface of the paper sheet P.

(Step S5: All-Nozzle Optimization Test Chart Reading Step)

The all-nozzle optimization test chart output on the paper sheet P is read by the inline sensor 140 (see FIG. 7), and the all-nozzle optimization test chart reading data (d2) are generated.

Here, a mode in which a user manually uses a reading apparatus such as a flatbed scanner to read the paper sheet P on which the all-nozzle optimization test chart has been output can be adopted, instead of the mode in which the test chart is automatically read using the inline sensor 140.

(Step S6: All-Nozzle Optimization Test Chart Reading Data Analyzing Step)

The all-nozzle optimization test chart reading data (d2) generated by the inline sensor 140 are acquired by the test chart reading data acquiring unit 158 (see FIG. 7), and are stored in the test chart reading data storage unit 160.

In the case where a user manually reads the all-nozzle optimization test chart, the user may input the all-nozzle optimization test chart reading data with an input device not shown in the figure. Then, they may be acquired by the test chart reading data acquiring unit 158, and may be stored in the test chart reading data storage unit 160.

The test chart reading data analyzing unit 162 (see FIG. 7) evaluates the corrected intensity of the non-discharge correction parameter for each nozzle, based on the all-nozzle optimization test chart reading data (d2 in FIG. 8) stored in the test chart reading data storage unit 160 (the detail is described later).

(Step S7: All-Nozzle Non-Discharge Correction Parameter Updating Step)

The non-discharge correction parameter updating unit 164 (see FIG. 7) updates the non-discharge correction parameter for each nozzle, based on the evaluation result of the all-nozzle test chart reading data. The updated non-discharge correction parameter for each nozzle is stored in the non-discharge correction parameter storage unit 152.

Thereafter, until the judgment of the completion of the repetitive process is made in step S2, the control unit 150 makes the non-discharge correction parameter storage unit 152, the test chart data generating unit 154, the test chart data storage unit 156, the test chart reading data acquiring unit 158, the test chart reading data storage unit 160, the test chart reading data analyzing unit 162 and the non-discharge correction parameter updating unit 164 process the same operation repetitively.

<Explanation of All-Nozzle Optimization Test Chart>

Figure 9:
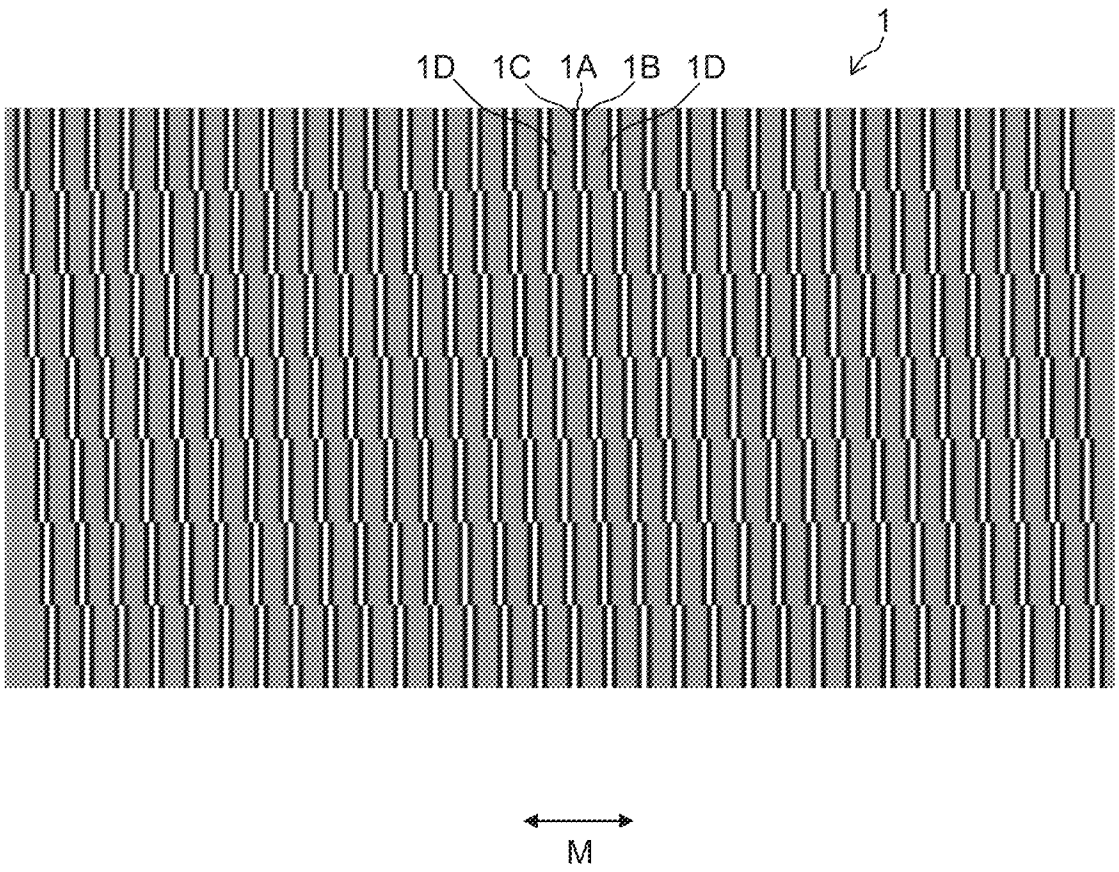
FIG. 9 is an explanatory diagram of a test chart that is applied to the all-nozzle optimizing process.

FIG. 9 is an explanatory diagram of the all-nozzle optimization test chart to be applied to the all-nozzle optimizing process.

An all-nozzle optimization test chart 1 shown in the figure arranges N stages of patterns each of which has simulated non-discharge regions 1A, at which the non-recording is given as a simulated non-discharge, at N-nozzle intervals (N=a natural number, N=7 in the figure), on a uniform concentration region 1D at which a solid image with a concentration value (gradation) of an optimized target is formed.

Further, non-discharge correction regions 1B, 1C adjacent to each simulated non-discharge region 1A have such a concentration that the non-discharge correction parameter is applied for the concentration of the uniform concentration region 1D.

For forming this all-nozzle optimization test chart 1, in the data of one stage of the test chart, the simulated non-discharge nozzles form the simulated non-discharge region 1A with a recording width equivalent to one nozzle, at N-nozzle intervals in the nozzle array direction M, without discharging ink. Further, the non-discharge correction nozzles at both sides to the simulated non-discharge nozzle respectively form the non-discharge correction regions 1B, 1C with a recording width equivalent to one nozzle, in accordance with a command value corrected by the non-discharge correction parameter. Further, the nozzles other than the simulated non-discharge nozzles and the non-discharge correction nozzles form the uniform concentration regions 1D, in accordance with a command value that is not corrected.

That is, the all-nozzle optimization test chart 1 shown in FIG. 9 has the simulated non-discharge regions 1A corresponding to the recording positions of the simulated non-discharge nozzles, the non-discharge correction regions 1B, 1C corresponding to the recording positions of the non-discharge correction nozzles that are the nozzles at both sides to the simulated non-discharge nozzles, and the uniform concentration regions 1D corresponding to the recording positions of the nozzles other than the simulated non-discharge nozzles and the non-discharge correction nozzles.

The multiple stages, in each of which the simulated non-discharge regions 1A are arranged at the constant intervals in the nozzle array direction M, are arranged along the paper sheet feed direction S. Further, the simulated non-discharge regions 1A in each stage are arranged at different positions in the nozzle array direction M from the simulated non-discharge regions 1A in the other stages.

The test chart data for forming the all-nozzle optimization test chart 1 are such data that the simulated non-discharge nozzle does not discharge ink, the nozzles forming the uniform concentration region 1D discharges ink based on the concentration value of the optimized target, and the non-discharge correction nozzle discharges ink at the concentration value of the optimized target in accordance with the command value corrected by the non-discharge correction parameter.

Concretely, they are such data that, when the concentration value of the optimized target is D and the nozzle number of the simulated non-discharge nozzle is i, the simulated non-discharge nozzle does not discharge ink, the non-discharge correction nozzles with nozzle numbers of i−1 and i+1 discharge ink in accordance with a command value of $D \times m_i$, and the nozzles with nozzle numbers of i−N+1, i−3, i−2, i+2, i+3, i+N−1 discharge ink in accordance with a command of D.

Further, the stages of the all-nozzle optimization test chart 1 are arranged such that the simulated non-discharge nozzles are deviated in the nozzle array direction. The all-nozzle optimization test chart 1 illustrated in FIG. 9 arranges the simulated non-discharge nozzles such that the nozzle numbers are deviated by one for each stage to be, for example, i, i+1, i+2, i+3, i+4 and i+5.

Thus, the simulated non-discharge nozzles in the stages are arranged so as to be deviated in the nozzle array direction, and thereby, it is possible to form the all-nozzle optimization test chart in which all nozzles are the simulated non-discharge nozzles, and to optimize the non-discharge correction parameters for all nozzles.

Here, the length (the length in the paper sheet feed direction S) of each stage of the all-nozzle optimization test chart 1 is determined in consideration of the reading length in the same direction of the reading apparatus, the performance of the reading apparatus (the scan period and the signal output period) and the feed speed of the paper sheet P.

<Explanation of Analysis of All-Nozzle Optimization Test Chart Reading Data>

For each simulated non-discharge nozzle, the average concentration in the nozzle array direction M at the uniform concentration region 1D near the simulated non-discharge region 1A is calculated, and the corrected intensity evaluation value indicating the intensity of the non-discharge correction is calculated. The corrected intensity evaluation value indicates an excessive correction if a positive value, indicates a weak correction if a negative value, and indicates that the non-discharge correction parameter is optimal, if zero.

As the corrected intensity evaluation value, for example, the difference amount between the average concentration and target concentration near the simulated non-discharge region 1A can be used. Further, the difference amount (chromaticity difference $\Delta E$) between the average chromaticity and target chromaticity, or the difference amount (luminance difference $\Delta Y$) between the average luminance and target luminance may be used.

<Explanation of Update of All-Nozzle Non-Discharge Correction Parameter>

In the embodiment, the non-discharge correction parameter updating unit 164 (see FIG. 7) updates the non-discharge correction parameter for each nozzle, based on a single-variable root-finding algorithm using an iterative method as typified by a bisection method and the like. That is, the corrected intensity evaluation value for the simulated non-discharge region 1A (see FIG. 9) is regarded as an evaluation function of the optimization algorithm, and the non-discharge correction parameter is regarded as a design variable of the root-finding algorithm.

Here, the root-finding algorithm means the overall numerical analysis algorithm that, for a function f(x), determines x meeting f(x)=0. Various methods such as the bisection method, the golden section method, the Brent method, the false position method and the Newton method belong to this.

Generally, these methods repeat a process of determining the next measurement point from n (about 1 or 2) initial or past measurement points based on the algorithms specific to the respective methods. In the embodiment, it is particularly preferable to use the Brent method. The Brent method is a good method in terms of both of convergence stability and convergence efficiency.

Figure 10:
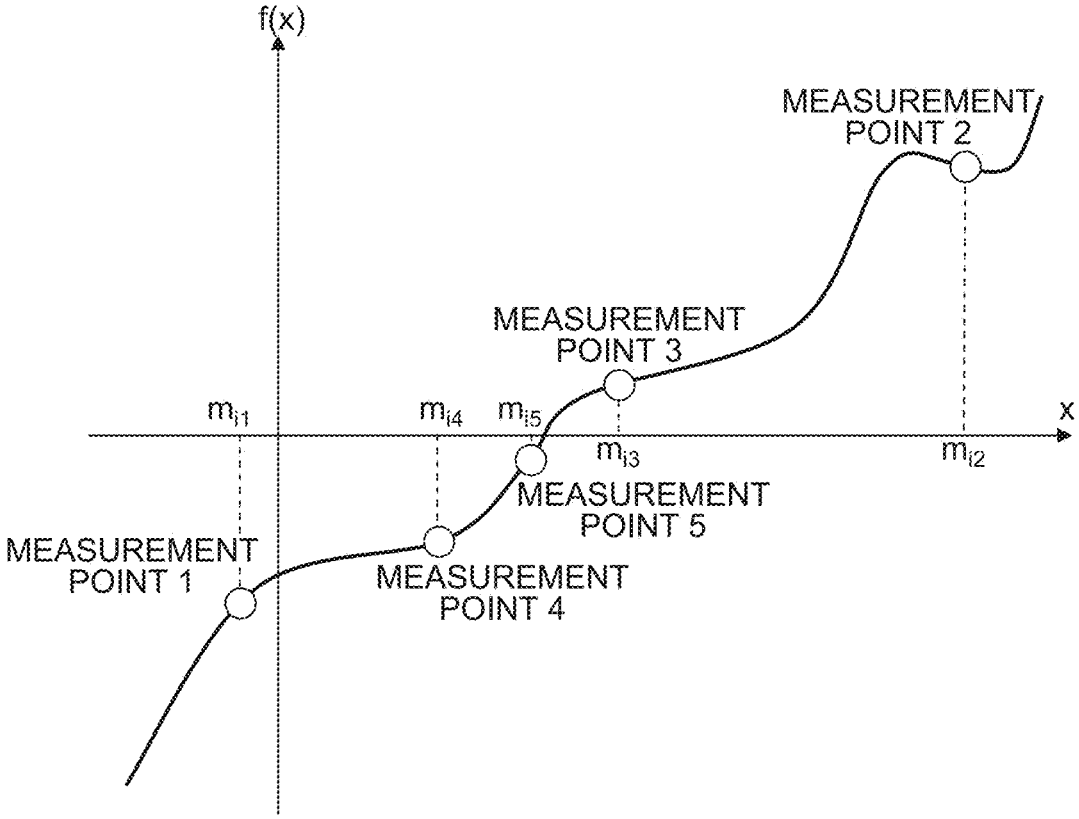
FIG. 10 is a schematic diagram showing a process by a root-finding algorithm.

FIG. 10, which is a schematic diagram showing a process of a root-finding algorithm, shows a manner in which the update of the non-discharge correction parameter for a nozzle with a nozzle number i is repeated five times.

First, $m_{i1}$ is set as the initial value of the non-discharge correction parameter for the nozzle with the nozzle number i (step S1 in FIG. 8), and the all-nozzle optimization test chart data (d1) are generated (step S3). Next, the all-nozzle optimization test chart is output based on the all-nozzle optimization test chart data (d1) (step S4), and is read by the inline sensor 140 (see FIG. 7) (step S5 in FIG. 8).

Moreover, the reading data is evaluated, and a corrected intensity evaluation value $f(m_{i1})$ (the measurement point 1 in FIG. 10) is calculated (step S6 in FIG. 8). The corrected intensity evaluation value $f(m_{i1})$ in FIG. 10 is a negative value, and it is found to be a weak correction.

The non-discharge correction parameter updating unit 164 updates the non-discharge correction parameter to $m_{i1}$, based on the corrected intensity evaluation value $f(m_{i1})$ in FIG. 10.

The flow returns to step S1 in FIG. 8, and based on this updated non-discharge correction parameter $m_{i1}$ (see FIG. 10), the all-nozzle optimization test chart data (d1 in FIG. 8) are generated, output and read. This reading data are evaluated, and a corrected intensity evaluation value $f(m_{i2})$ (the measurement point 2 in FIG. 10) is calculated. The corrected intensity evaluation value $f(m_{i2})$ is a positive value, and it is found to be an excessive correction.

The non-discharge correction parameter updating unit 164 updates the non-discharge correction parameter to $m_{i3}$, based on the corrected intensity evaluation values $f(m_{i1})$, $f(m_{i2})$. Then, a corrected intensity evaluation values $f(m_{i3})$ (the measurement point 3) is calculated, and the non-discharge correction parameter is updated to $m_{i4}$.

Thus, by repeating the process of the root-finding algorithm, it is possible to efficiently optimize the non-discharge correction parameter for all nozzles. Here, the repetitive process only needs to be performed at least two times. For example, in a simple bisection method or the like, it seems that, when two points across a solution are measured, the median point is closer to the optimum value than the two points.

By altering the concentration value of the processing target and performing the same process, it is possible to optimize the non-discharge correction parameter for all concentration values (gradations). For altering the concentration value of the processing target, it is only necessary to alter the concentration value at the uniform concentration region 1D in the all-nozzle optimization test chart 1.

In the embodiment, from the aspects of the efficiency and accuracy, it is preferable that the initial value of the non-discharge correction parameter be set to a value as close to the optimum value as possible. For determining the initial value, it is preferable to use a method by the calculation of a theoretical right answer value from the halftone information and the concentration design information, a method by the rough measurement of the non-discharge correction parameter by experiments, or the like.

Further, in the case where the non-discharge correction parameter is once optimized and, after the elapse of a certain period of time, the non-discharge correction parameter is adjusted again, the last-time non-discharge correction parameter result can be utilized as the initial value. As for the judgment of the completion of the repetitive process, when the corrected intensity evaluation value such as the chromaticity difference ΔE or the luminance difference ΔY gets to be a certain value or less for all the nozzles that are intended to be optimized, the judgment of the completion may be made. Alternatively, the upper limit n of the number of repetition times may be previously determined, and when the corrected intensity evaluation value gets to be a certain value or less for all the nozzles, the judgment of the completion may be made at that time point.

In the above all-nozzle non-discharge correction parameter updating process, the non-discharge correction parameter is directly the design variable of the root-finding algorithm. This implicitly includes an assumption "the non-discharge correction parameters to be given to the bilateral nozzles to the non-discharge nozzle have the same value".

However, the arrangement of the nozzles on the head is not always bilaterally symmetric, and therefore, in some cases, the non-discharge correction by using bilaterally different parameters can be effective. In such cases, non-discharge correction parameters that are a plurality of correction parameters to be designated by a common variable can be used and applied to the bilateral non-discharge correction nozzles.

For example, a correction parameter $P_L$ for a non-discharge correction nozzle at the left side and a correction parameter $P_R$ for a non-discharge correction nozzle at the right side are defined as the following general formula, using a common variable x in both.

$$P_L=g(x), P_R=h(x) \quad \text{(Formula 1)}$$

Here, g(x) and h(x) are arbitrary functions whose variable is x. With such a definition, the design variable of the root-finding algorithm according to the embodiment is set to x, and thereby, it is possible to optimize the non-discharge correction parameters designated by the bilaterally different correction parameters.

Examples of the functions g(x) and h(x) include the following.

$$g(x)=x, h(x)=x \quad \text{(Formula 2)}$$

In this case, similarly to the all-nozzle non-discharge correction parameter updating process explained above, it is possible to deal with the bilateral non-discharge correction nozzles such that the same non-discharge correction parameter is applied.

$$g(x)=a\times x, h(x)=b\times x \text{ (}a\text{ and }b\text{ are different constants from each other)} \quad \text{(Formula 3)}$$

In this case, it is possible to generate such non-discharge correction parameters that the bilateral non-discharge correction nozzles have different correction parameters from each other.

$$g(x)=x, h(x)=c \text{ (}c\text{ is a constant)} \quad \text{(Formula 4)}$$

In this case, it is possible to fix the correction parameter for one (right side) non-discharge correction nozzle of the bilateral nozzles, and to generate such a non-discharge correction parameter that only the correction parameter for the other (left side) non-discharge correction nozzle is optimized.

As for the correction parameters designated by these Formula 2 to Formula 4, the correction parameter by any formula can be applied evenly to all nozzles, or the correction parameter by an optimum formula can be selected and applied for each non-discharge nozzle.

In addition, it is allowable to be a mode in which a plurality of parameters of the non-discharge correction parameters are a correction parameter $Q_1$ to be applied to the nozzles (nozzle numbers of i±1) at both sides to the non-discharge nozzle (a nozzle number of i) and further a correction parameter $Q_2$ to be applied to the nozzles (nozzle numbers of i±2) adjacent to the nozzles at both sides, these are designated by a function x using a common variable, this x is set as the design variable of the root-finding algorithm, and the optimization is performed.

<Explanation of Problems of All-Nozzle Optimizing Process>

Here, problems of the above all-nozzle optimizing process are explained. The above all-nozzle optimizing process has the following problems, in association with already-known non-discharge nozzles.

(Problem 1)

In the case of a printing system (for example, a system in which the ink discharge is stable) allowing for an assumption that the non-discharge correction parameters for only already-known non-discharge nozzles just have to be optimized, the process of optimizing the non-discharge correction parameters for all nozzles is a redundant process. Since the non-discharge correction parameters for the already-known non-discharge nozzles just have to be optimized, a further effective scheme is desired.

(Problem 2)

The non-discharge correction parameters for the nozzles near the already-known non-discharge nozzles are not optimized. In the case where the already-known non-discharge nozzles exist, the optimum values of the non-discharge correction parameters for the nozzles near the non-discharge nozzles attempt to be searched in consideration of the influence of the already-known non-discharge nozzles.

However, the non-discharge correction parameters for the already-known non-discharge nozzles are unoptimized in the initial state, and therefore, the values are changed in connection with the execution of the optimizing process for the non-discharge correction parameters. Therefore, there is a possibility that the convergence values of the non-discharge correction parameters for the nozzles near the already-known non-discharge nozzles do not become optimized values, by the influence of the unoptimized already-known non-discharge nozzles.

Figure 11:
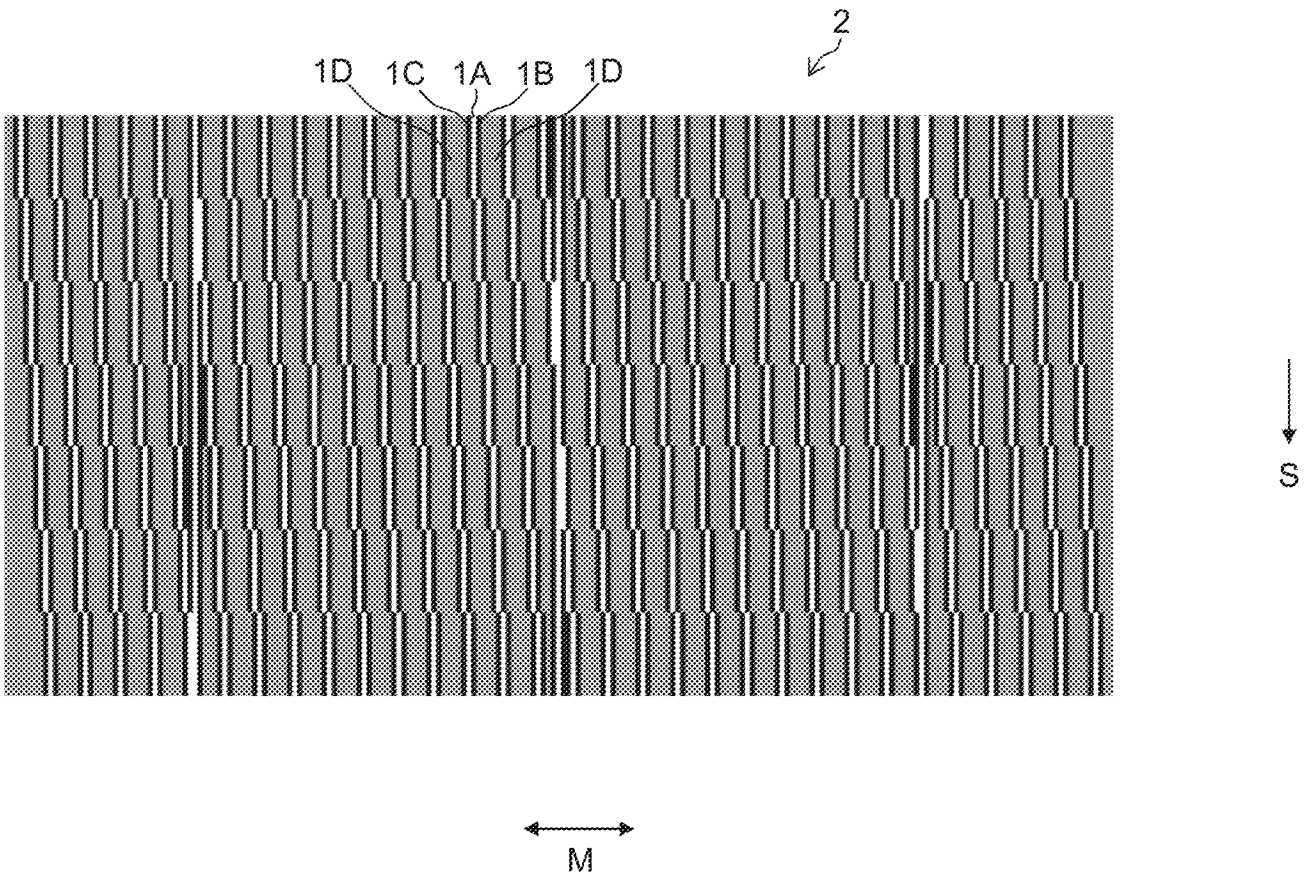
FIG. 11 is an explanatory diagram for explaining problems of the all-nozzle optimizing process when an already-known non-discharge nozzle exists.

A test chart 2 illustrated in FIG. 11, which is a test chart to be applied to the all-nozzle optimizing process, schematically illustrates a state in which the influence of already-known non-discharge nozzles having unoptimized non-discharge correction parameters is mixed.

In the following, an all-nozzle optimizing process to solve the above Problems 1, 2 and to efficiently optimize the non-discharge correction parameters for all nozzles, even when an already-known non-discharge nozzle exists is described in detail.

<Explanation of Flowchart>

Figure 12:
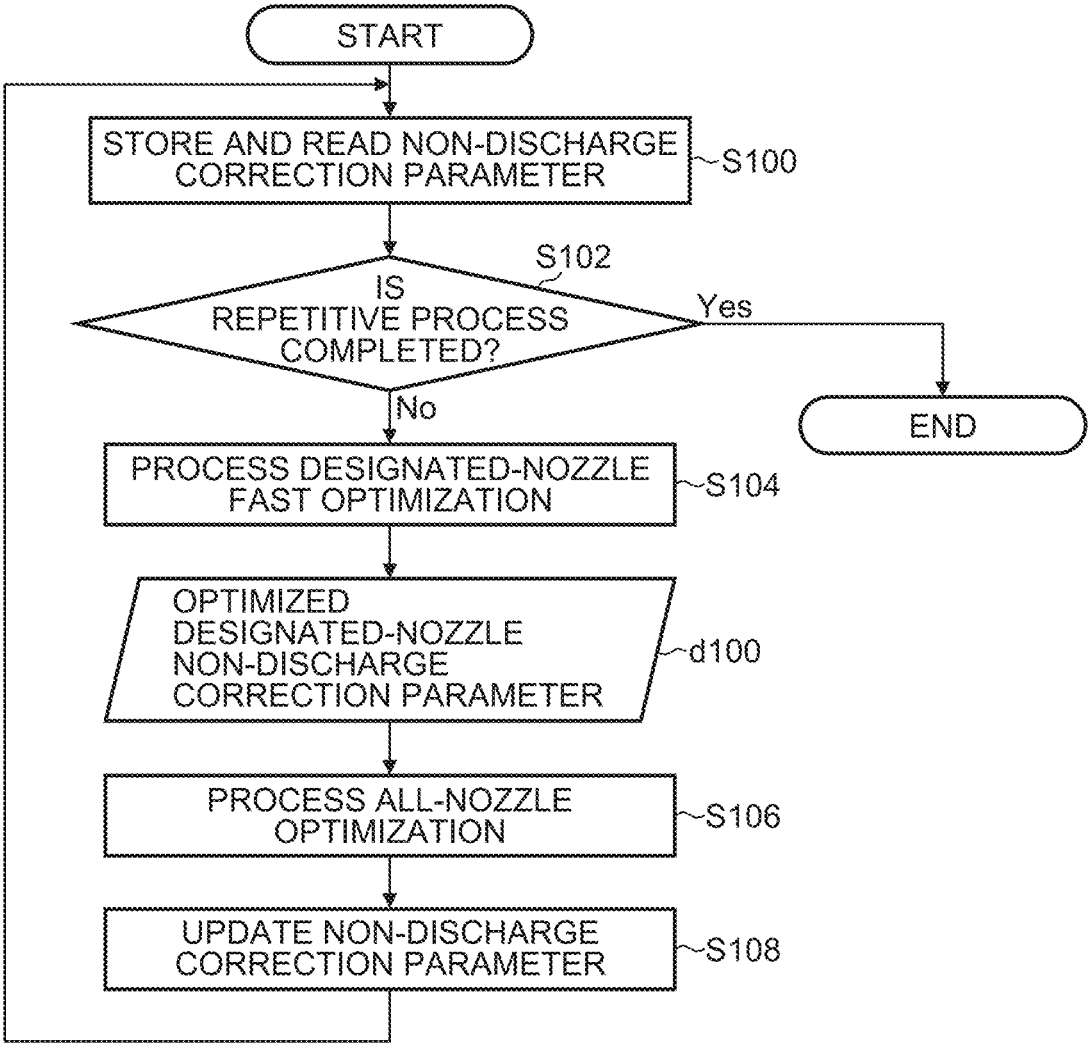
FIG. 12 is a flowchart showing the flow of a non-discharge correction parameter optimizing process according to a second embodiment of the present invention.

FIG. 12 is a flowchart showing the flow of the non-discharge correction parameter optimizing process according to the second embodiment of the present invention. Here, in the flowchart explained below, for identical or similar steps to the steps in the non-discharge correction parameter optimizing process explained previously and identical or similar devices to the devices therefor, the explanations are omitted or simplified.

(Step S100: Non-Discharge Correction Parameter Reading Step)

In the non-discharge correction parameter reading step shown in step S100, the latest non-discharge correction parameter stored previously is read.

(Step S102: Repetitive Process Completion Judging Step)

In the repetitive process completion judging step shown in step S102, whether the repetitive process is completed is judged. If the judgment that the repetitive process is completed (the Yes judgment) is made in step S102, the non-discharge correction parameter optimizing process ends.

On the other hand, if the judgment that the repetitive process is not completed (the No judgment) is made in step S102, the flow proceeds to step S104.

(Step S104: Designated-Nozzle Fast Optimization Processing Step)

In the designated-nozzle fast optimization processing step shown in step S104, the designated nozzle is an already-known non-discharge nozzle, and the designated-nozzle fast optimization process is executed so that an optimized designated-nozzle non-discharge correction parameter (d100) is generated.

The optimized designated-nozzle non-discharge correction parameter generated in step S104 is stored in the non-discharge correction parameter storage unit 152 in FIG. 7. As the designated-nozzle fast optimizing process in step S104, the designated-nozzle fast optimization process (see FIG. 2) explained in the first embodiment is applied.

(Step S106: All-Nozzle Optimization Processing Step)

In the all-nozzle optimization processing step shown in step S106, the all-nozzle optimizing process is executed using the optimized designated-nozzle non-discharge correction parameter stored in the non-discharge correction parameter storage unit 152. As the all-nozzle optimizing process in step S106, the all-nozzle optimizing process explained above is applied (see FIG. 8).

(Step S108: Non-Discharge Correction Parameter Updating Step)

When the non-discharge correction parameters for all nozzles shown in step S108 are optimized, the non-discharge correction parameters for all nozzles are updated.

(Step S100: Non-Discharge Correction Parameter Storing Step)

The updated non-discharge correction parameter shown in step S100 is stored in the non-discharge correction parameter storage unit 152 in FIG. 7, as the latest non-discharge correction parameter.

Thus, by combining the designated-nozzle fast optimizing process and the all-nozzle optimizing process, it is possible to efficiently optimize the non-discharge correction parameters for all nozzles, even when an already-known non-discharge nozzle exists.

Third Embodiment

Next, a third embodiment of the present invention is explained. The third embodiment explained below further increases the efficiency of the non-discharge correction parameter optimizing process according to the second embodiment. Here, in the flowchart explained below, for identical or similar steps to the steps in the non-discharge correction parameter optimizing process explained previously and identical or similar devices to the devices, the explanations are omitted or simplified.

Figure 13:
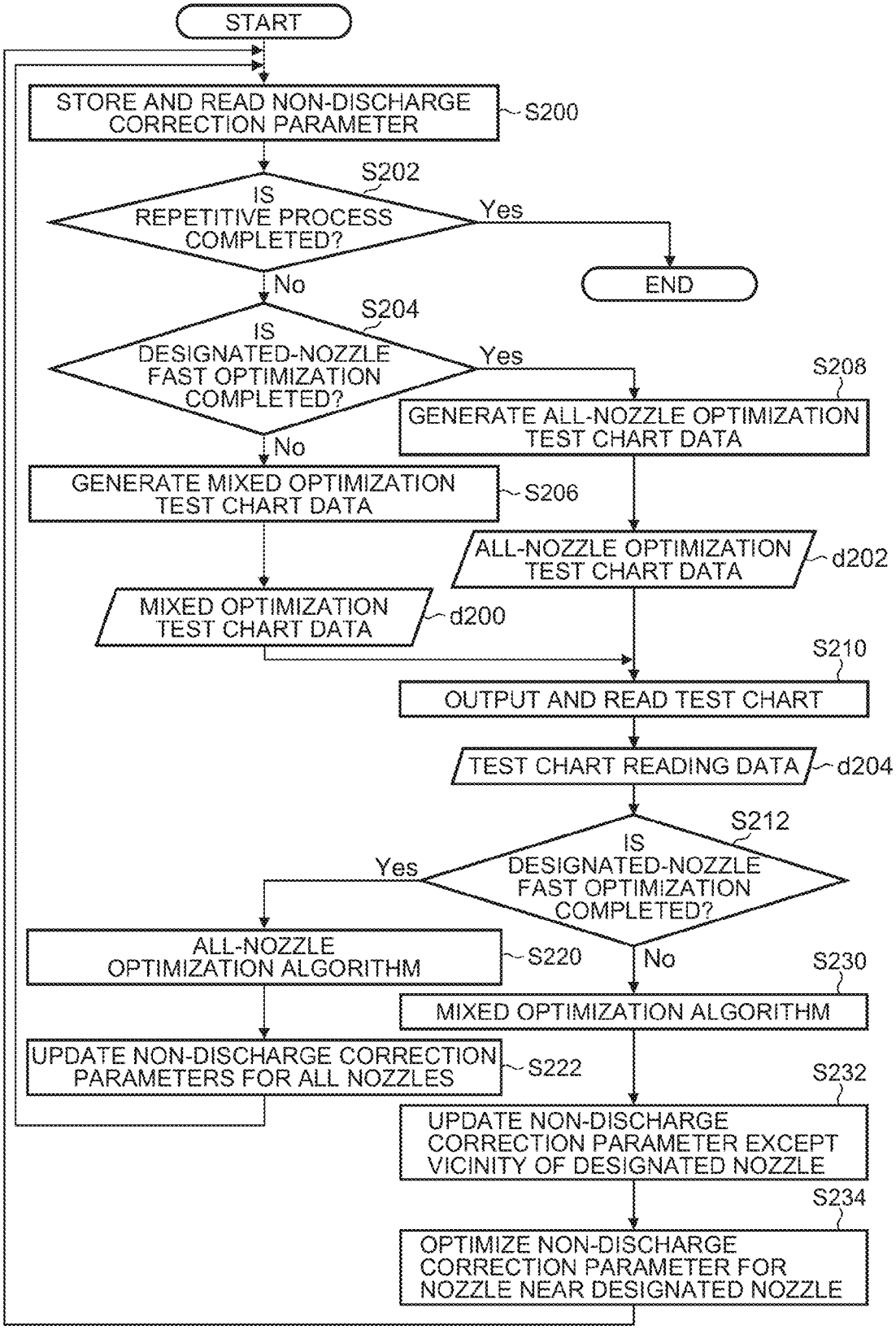
FIG. 13 is a flowchart showing the flow of a non-discharge correction parameter optimizing process according to a third embodiment of the present invention.

FIG. 13 is a flowchart showing the flow of an all-nozzle optimizing process according to the third embodiment.

(Step S200: Non-Discharge Correction Parameter Reading Step)

In the non-discharge correction parameter reading step shown in step S200, the latest non-discharge correction parameter that is previously stored is read.

(Step S202: Repetitive Process Completion Judging Step)

In the repetitive process completion judging step shown in step S202, whether the repetitive process is completed is judged. If the judgment that the repetitive process is completed (the Yes judgment) is made in step S202, the non-discharge correction parameter optimizing process ends.

On the other hand, if the judgment that the repetitive process is not completed (the No judgment) is made in step S202, the flow proceeds to step S204.

(Step S204: Designated-Nozzle Fast Optimization Completion Judging Step)

In the designated-nozzle fast optimization judging step shown in step S204, whether the optimization of the non-discharge correction parameter for the designated nozzle is completed is judged. If the judgment that the optimization of the non-discharge correction parameter for the designated nozzle is completed (the Yes judgment) is made in step S204, the flow proceeds to step S208.

On the other hand, if the judgment that the optimization of the non-discharge correction parameter for the designated nozzle is not completed (the No judgment) is made in step S204, the flow proceeds to step S206.

(Step S206: Mixed Optimization Test Chart Data Generating Step)

In the mixed optimization test chart generating step shown in step S206, mixed optimization test chart data (d200) for integrally configuring the designated-nozzle fast optimization test chart and the all-nozzle optimization test chart are generated, and then the flow proceeds to step S210.

(Step S208: All-Nozzle Optimization Test Chart Data Generating Step)

In the all-nozzle optimization test chart data generating step shown in step S208, all-nozzle optimization test chart data (d202) are generated in consideration of the non-discharge correction parameter for the optimized designated nozzle, and then the flow proceeds to step S210.

The all-nozzle optimization test chart data (d202) to be generated in the all-nozzle optimization test chart data generating step are the same as the all-nozzle optimization test chart data (d1) in FIG. 8.

(Step S210: Test Chart Outputting and Reading Step)

In the test chart outputting step shown in step S210, a mixed optimization test chart based on the mixed optimization test chart data (d200) generated in step S206, or an all-nozzle optimization test chart based on the all-nozzle optimization test chart data (d202) generated in step S208 is output. The output test chart is read, and test chart reading data (d204) are generated. Then, the flow proceeds to step S212.

Here, the test chart reading data (d204) are mixed optimization test chart reading data in the case where the mixed optimization test chart is output, or all-nozzle optimization test chart reading data in the case where the all-nozzle optimization test chart is output.

(Step S212: Designated-Nozzle Fast Optimization Completion Judging Step)

In the designated-nozzle fast optimization completion judging step shown in step S212, whether the optimization of the non-discharge correction parameter for the designated nozzle is completed is judged. For the judgment result in step S212, the judgment result in the designated-nozzle fast optimization completion judging step shown in step S204 can be referred.

If the judgment that the optimization of the non-discharge correction parameter for the designated nozzle is completed (the Yes judgment) is made in step S212, the flow proceeds to step S220. On the other hand, if the judgment that the optimization of the non-discharge correction parameter for the designated nozzle is not completed (the No judgment) is made in step S212, the flow proceeds to step S230.

(Step S220: All-Nozzle Optimization Algorithm Executing Step)

In the all-nozzle optimization algorithm executing step shown in step S220, a non-discharge correction parameter optimization algorithm (process) for all nozzles is executed, and then the flow proceeds to step S222. Here, the all-nozzle optimizing process explained using FIG. 8 is applied, and therefore, the detailed explanation is omitted.

(Step S222: All-Nozzle Non-Discharge Correction Parameter Updating Step)

In the all-nozzle non-discharge correction parameter updating step shown in step S222, the non-discharge correction parameters for all nozzles are updated, and then the flow proceeds to step S200.

(Step S230: Mixed Optimization Algorithm Executing Step)

In the mixed optimization algorithm executing step shown in step S230, using the mixed optimization test chart (illustrated in FIG. 14 and FIG. 15), the type of the nozzle is classified into three types, and an individual process for each type of the nozzles is performed.

That is, all nozzles are classified into three types: the designated nozzle and the non-discharge correction nozzle; the nozzle near the designated nozzle; and the nozzle other than the designated nozzle, the non-discharge correction nozzle, and the nozzle near the designated nozzle.

Here, the "nozzle near the designated nozzle" is a nozzle for which the non-discharge correction parameter is not optimized by the all-nozzle optimizing process because of the influence of the already-known non-discharge nozzle, and includes at least an opposite adjacent nozzle to the non-discharge nozzle with respect to the non-discharge correction nozzle.

That is, when the nozzle number of the non-discharge nozzle is i and the non-discharge correction nozzles are the i+1-th nozzle and the i−1-th nozzle, at least the i+2-th nozzle and the i−2-th nozzle are the "nozzle near the designated nozzle". Here, the "nozzle near the designated nozzle" can be arbitrarily set.

The designated-nozzle optimizing process is executed for the designated nozzle and the non-discharge correction nozzle, the non-processing is provided for the nozzle near the designated nozzle, and the all-nozzle optimizing process is executed for the other nozzles. Then, the flow proceeds to step S232.

(Step S232: Non-Discharge Correction Parameter Updating Step for Nozzles Except Nozzle Near Designated Nozzle)

In the non-discharge correction parameter updating step for the nozzles except the nozzle near the designated nozzle shown in step S232, the non-discharge correction parameters are updated for the nozzles except the nozzle near the designated nozzle (the designated nozzle, the non-discharge correction nozzle and the other nozzles). Then, the flow proceeds to step S234.

(Step S234: Non-Discharge Correction Parameter Optimization Processing Step for Nozzle Near Designated Nozzle)

In the non-discharge correction parameter processing step for the nozzle near the designated nozzle shown in step S234, the optimizing process for the non-discharge correction parameter and the updating process for the non-discharge correction parameter are executed for the nozzle near the designated nozzle. Then, the flow proceeds to step S200.

(Step S200: Non-Discharge Correction Parameter Storing Step)

In the non-discharge correction parameter storing step, for all nozzles, the updated non-discharge correction parameters are stored in the non-discharge correction parameter storage unit 152 in FIG. 7.

<Detailed Explanation of Mixed Optimization Process>

Figure 14:
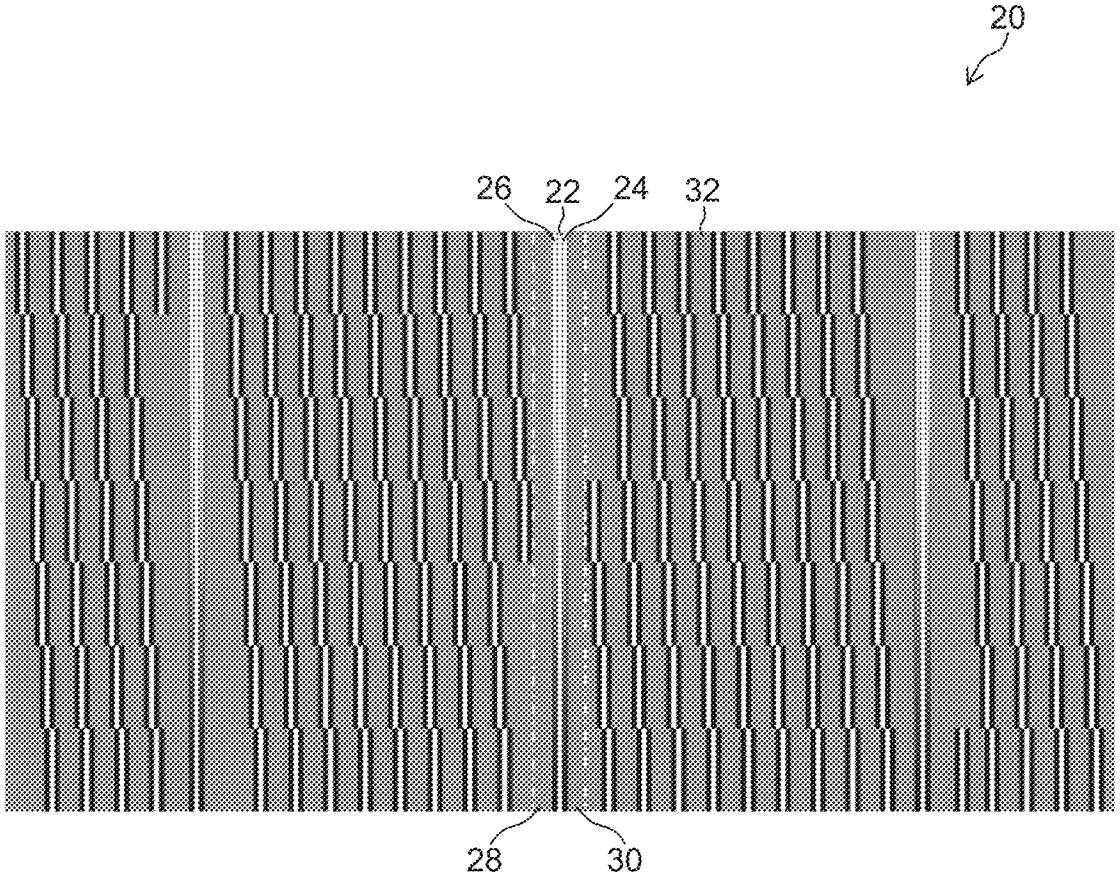
FIG. 14 is a configuration diagram of a mixed optimization test chart that is applied to the non-discharge correction parameter optimizing process shown in FIG. 13.

FIG. 14 is a configuration diagram schematically illustrating the configuration of a first mixed optimization test chart 20 (third test chart) that is used for the mixed optimization algorithm shown in step S230.

The first mixed optimization test chart 20 shown in the figure is configured by non-recording regions 22 corresponding to the recording positions of the designated nozzles, chart regions 24, 26 corresponding to the recording positions of the non-discharge correction nozzles, uniform concentration regions 28, 30 corresponding to the recording positions of the nozzles near the designated nozzles, and all-nozzle optimization chart regions 32 for the recording positions of the other nozzles except the designated nozzles, the non-discharge correction nozzles and the nozzles near the designated nozzles.

That is, a first chart configured by a pattern corresponding to the designated-nozzle fast optimization test chart 10 (see FIG. 3) is formed at the non-recording region 22 corresponding to the recording position of the designated nozzle, at the chart regions 24, 26 corresponding to the recording positions of the non-discharge correction nozzles, and at the uniform concentration regions 28, 30 corresponding to the recording positions of the nozzles near the designated nozzle. Further, a second chart configured by a pattern corresponding to the all-nozzle optimization test chart 1 is formed at the all-nozzle optimization chart region 32 for the recording positions of the other nozzles except the designated nozzle, the non-discharge correction nozzles and the nozzles near the designated nozzle.

At the non-recording region 22, the non-recording is provided. At the chart regions 24, 26, measurement charts in which a plurality of non-discharge correction parameters are continuously or intermittently applied are formed, similarly to the measurement chart regions 14, 16 illustrated in FIG. 3.

Further, at the uniform concentration regions 28, 30, a solid pattern with a uniform concentration of a concentration value of the processing target is formed. At the all-nozzle optimization chart region 32, the all-nozzle optimization test chart illustrated in FIG. 9 is formed.

In the non-discharge correction parameter optimizing process using the first mixed optimization test chart 20 illustrated in FIG. 14 (in the mixed optimization algorithm executing step shown in step S230 of FIG. 13), the designated-nozzle fast optimizing process according to the first embodiment is applied to the designated nozzle and the non-discharge correction nozzles, the non-processing is applied to the nozzles near the designated nozzle, and the all-nozzle optimizing process is applied to the other nozzles.

By the mixed optimization algorithm executing step, the non-discharge correction parameters are optimized for the nozzles other than the nozzles near the designated nozzle. Then, the optimizing process of the non-discharge correction parameter is performed for the nozzles near the designated nozzle, to which the non-processing is applied.

Figure 15:
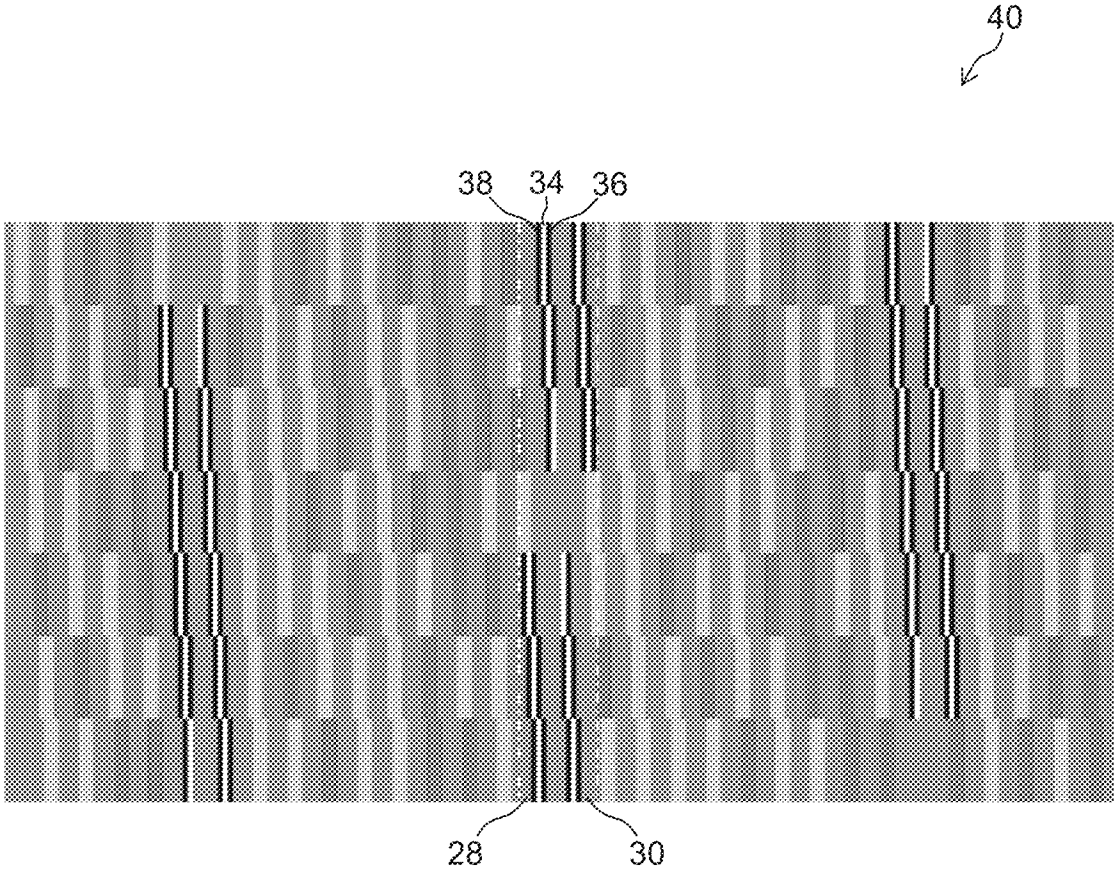
FIG. 15 is a configuration diagram of an optimization test chart for a nozzle adjacent to a non-discharge correction nozzle in the non-discharge correction parameter optimizing process shown in FIG. 13.

FIG. 15 is a configuration diagram schematically illustrating the configuration of a second mixed optimization test chart 40 (fourth test chart) that is applied to the non-discharge correction parameter optimizing process for the nozzles near the designated nozzle.

In the second mixed optimization test chart 40 shown in FIG. 15, a simulated non-discharge region 34 and non-discharge correction regions 36, 38 are formed at the uniform concentration region 28, 30 (see FIG. 14) corresponding to the recording positions of the nozzles near the designated nozzle.

At the simulated non-discharge region 34, the non-recording is provided, similarly to the simulated non-discharge region 1A shown in FIG. 9. At the non-discharge correction regions 36, 38 in FIG. 15, a concentration pattern in which the non-discharge correction parameter is applied to the concentration at the uniform concentration region 1D is provided, similarly to the non-discharge correction regions 1B, 1C in FIG. 9.

The all-nozzle optimizing process is applied to the nozzles near the designated nozzle, using the second mixed optimization test chart 40, so that the non-discharge correction parameters are optimized and updated.

The above non-discharge correction parameter optimizing process for the designated nozzle, the non-discharge nozzle and the nozzle near the designated nozzle may be repeated twice or more.

In the above explained non-discharge correction parameter optimizing process according to the third embodiment, by combining the designated-nozzle optimizing process and the all-nozzle optimizing process, the non-discharge correction parameters for all nozzles are efficiently optimized, without being influenced by an already-known non-discharge nozzle.

[Explanation of Another Exemplary Apparatus Configuration]

Next, another exemplary apparatus configuration to which the non-discharge correction parameter optimizing process according to the present invention is applied is explained.

<Overall Configuration>

Figure 16:
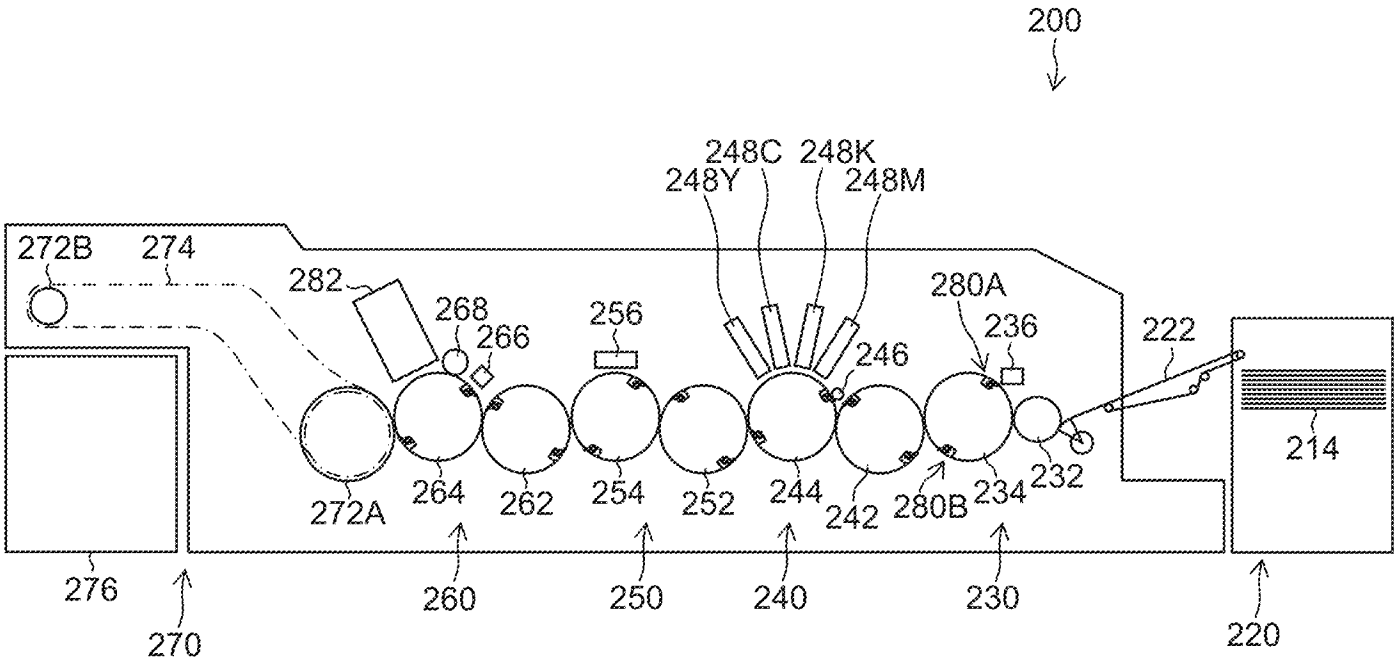
FIG. 16 is a configuration diagram showing the overall configuration of another exemplary apparatus configuration.

FIG. 16 is a configuration diagram showing the overall configuration of an ink-jet recording apparatus having another exemplary apparatus configuration. An ink-jet recording apparatus 200 shown in the figure is a two-liquid agglutination type recording apparatus that uses an ink containing a coloring material and a agglutination treatment liquid having a function to agglutinate the ink, and thereby forms an image on the recording surface of a recording medium 214 (paper sheet P) based on predetermined image data.

The ink-jet recording apparatus 200 is configured to include mainly a paper feeding unit 220, a treatment liquid applying unit 230, a drawing unit 240, a drying treatment unit 250, a fixing treatment unit 260 and an ejecting unit 270.

At the former stages of the treatment liquid applying unit 230, the drawing unit 240, the drying treatment unit 250 and the fixing treatment unit 260, transfer cylinders 232, 242, 252, 262 are provided, as devices that performs the transfer of the recording medium 214 to be fed. Therewith, at each of the treatment liquid applying unit 230, the drawing unit 240, the drying treatment unit 250 and the fixing treatment unit 260, impression cylinders 234, 244, 254, 264 having a drum shape are provided, as a device that transfers the recording medium 214 while holding it.

The transfer cylinders 232, 242, 252, 262, and the impression cylinders 234, 244, 254, 264 are provided with grippers 280A, 280B that grips and holds the edge parts of the recording medium 214, at predetermined positions on the circumference surfaces. The structures for gripping and holding the end parts of the recording medium 214 in the grippers 280A and the grippers 280B, and the structures for performing the transfer of the recording medium 214 between the grippers provided on different impression cylinders or transfer cylinders are common. The grippers 280A and the grippers 280B are arranged at symmetric positions on the circumference surfaces of the impression cylinders 234, 244, 254, 264 so as to deviate by 180° in the rotation direction of the impression cylinders 234, 244, 254, 264.

When the transfer cylinders 232, 242, 252, 262 and the impression cylinders 234, 244, 254, 264 are rotated in a predetermined direction in a state in which the grippers 280A, 280B grip the edge parts of the recording medium 214, the recording medium 214 is rotated and fed along the circumference surfaces of the transfer cylinders 232, 242, 252, 262 and impression cylinders 234, 244, 254, 264.

Here, in FIG. 16, reference characters are marked only for the grippers 280A, 280B provided on the impression cylinder 234, and the reference characters for the grippers of the other impression cylinders and transfer cylinders are omitted.

When the recording medium (flat paper) 214 contained in the paper feeding unit 220 is fed to the treatment liquid applying unit 230, the agglutination treatment liquid (treatment liquid) is added on the recording surface of the recording medium 214 held on the circumference surface of the impression cylinder 234 (on the outer surface in a state of being held by the impression cylinders 234, 244, 254, 264).

Thereafter, the recording medium 214 on which the agglutination treatment liquid has been added is sent to the drawing unit 240, and, in the drawing unit 240, color inks are added on the region of the recording surface where the agglutination treatment liquid has been added, so that an intended image is formed.

Further, the recording medium 214 on which the image by the color inks has been formed is sent to the drying treatment unit 250, a drying treatment is performed in the drying treatment unit 250, and a fixing treatment is performed in the fixing treatment unit 260. After the intended image is formed on the recording surface of the recording medium 214 and the image is fixed on the recording surface of the recording medium 214, it is fed from the ejecting unit 270 to the exterior of the apparatus.

In the following, the respective units (the paper feeding unit 220, the treatment liquid applying unit 230, the drawing unit 240, the drying treatment unit 250, the fixing treatment unit 260 and the ejecting unit 270) of the ink-jet recording apparatus 200 are explained in detail.

(Paper Feeding Unit)

The paper feeding unit 220 is provided with a paper feeding tray 222 and an advancing mechanism not shown in the figure, and is configured such that the recording medium 214 is advanced from the paper feeding tray 222 on a single sheet basis.

(Treatment Liquid Applying Unit)

The treatment liquid applying unit 230 is configured to include a treatment liquid cylinder 234 that holds the recording medium 214 transferred from a transfer cylinder (a paper feeding cylinder) 232 on the circumference surface and feeds the recording medium 214 in a predetermined feeding direction, and a treatment liquid applying apparatus 236 that adds the treatment liquid on the recording surface of the recording medium 214 held on the circumference surface of the treatment liquid cylinder 234.

The treatment liquid applying apparatus 236 shown in FIG. 16 is provided at a position facing the circumference surface (recording medium holding surface) of the treatment liquid cylinder 234. As a configuration example of the treatment liquid applying apparatus 236, there is a mode to include a treatment liquid container in which the treatment liquid is pooled, an anilox roller that is partially immersed in the treatment liquid within the treatment liquid container and measures the treatment liquid within the treatment liquid container, and an applying roller that moves the treatment liquid measured by the anilox roller to the recording medium 214.

The treatment liquid to be added to the recording medium 214 by the treatment liquid applying apparatus 236 contains a coloring material coagulant that agglutinates the coloring material (pigment) in the ink to be applied in the drawing unit 240, and the contact of the treatment liquid with the ink on the recording medium 214 promotes the separation of the coloring material and solvent in the ink.

(Drawing Unit)

The drawing unit 240 includes a drawing cylinder 244 that holds and feeds the recording medium 214, a paper sheet pressing roller 246 for tightly contacting the recording medium 214 with the drawing cylinder 244, and ink-jet heads 248M, 248K, 248C, 248Y that adds the ink to the recording medium 214. The basic structure of the drawing cylinder 244 is common with the treatment liquid cylinder 234 explained previously.

A paper sheet floating detection sensor (not shown in the figure) is disposed between the paper sheet pressing roller 246 and the ink-jet head 248M, which is at the upmost stream side in the feed direction of the recording medium 214. The paper sheet floating detection sensor detects the floating amount immediately before the recording medium 214 enters just below the ink-jet heads 248M, 248K, 248C, 248Y.

The recording medium 214 transferred from the transfer cylinder 242 to the drawing cylinder 244 is rotated and fed in a state in which the edges are held by the grippers (the reference characters are omitted), and on this occasion, is pressed by the paper sheet pressing roller 246 so as to be tightly contacted with the circumference surface of the drawing cylinder 244.

The ink-jet heads 248M, 248K, 248C, 248Y, which correspond to four colors of inks of magenta (M), black (K), cyan (C) and yellow (Y) respectively, are arranged in the rotation direction of the drawing cylinder 244 (the counterclockwise direction in FIG. 16) from the upstream side, in that order, and are arranged such that the ink discharge surfaces (nozzle surfaces) of the ink-jet heads 248M, 248K, 248C, 248Y face the recording surface of the recording medium 214 held on the drawing cylinder 244.

Further, the ink-jet heads 248M, 248K, 248C, 248Y shown in FIG. 16 are arranged in an inclined manner with respect to the horizontal plane, such that the nozzle surfaces of the ink-jet heads 248M, 248K, 248C, 248Y are parallel to the recording surface of the recording medium 214 held on the circumference surface of the drawing cylinder 244.

The ink-jet heads 248M, 248K, 248C, 248Y are full-line type heads that have a length corresponding to the maximum width of the image formation region in the recording medium 214 (the length in the direction perpendicular to the feed direction of the recording medium 214), and are fixedly provided so as to extend in the direction perpendicular to the feed direction of the recording medium 214.

When the recording medium 214 is fed to the printing region just below the ink-jet heads 248M, 248K, 248C, 248Y, the respective color inks are discharged (landed) from the ink-jet heads 248M, 248K, 248C, 248Y to the region in the recording medium 214 on which the agglutination treatment liquid has been added, based on the image data.

When the ink-jet heads 248M, 248K, 248C, 248Y discharge droplets of the corresponding color inks toward the recording surface of the recording medium 214 held on the circumference surface of the drawing cylinder 244, the inks contact with the treatment liquid on the recording medium 214, leading to the occurrence of an agglutination reaction of coloring materials dispersed in the inks (pigment-type coloring materials) or insolubilized coloring materials (dye-type coloring materials), and the formation of coloring material aggregates. This prevents the movement of the coloring materials (the positional deviation of dots and the color unevenness of dots) in the image formed on the recording medium 214.

(Drying Treatment Unit)

The drying treatment unit 250 includes a drying cylinder 254 that holds and feeds the recording medium 214 after the image formation, and a drying treatment apparatus 256 that performs a drying treatment for evaporating the moisture (liquid components) on the recording medium 214.

The drying treatment apparatus 256, which is disposed at a position facing the circumference surface of the drying cylinder 254, is a treatment unit that evaporates the moisture existing on the recording medium 214. Configuration examples of the drying treatment apparatus 256 include a mode to evaporate the liquid components existing on the recording medium 214, by the heating with a heater, the air-sending with a fan, or the combination of them.

(Fixing Treatment Unit)

The fixing treatment unit 260 is configured to include a fixing cylinder (fixing drum) 264 that holds and feeds the recording medium 214, a heater 266 that performs heating treatment to the recording medium 214, and a fixing roller 268 that presses the recording medium 214 from the recording surface side.

The fixing treatment unit 260 performs preliminary heating treatment with the heater 266, to the recording surface of the recording medium 214, and therewith, performs fixing treatment with the fixing roller 268. The heating temperature of the heater 266 is appropriately set depending on the type of the recording medium, the types of the inks (the types of fine polymer particles contained in the inks) and the like.

In the ink-jet recording apparatus 200 shown in FIG. 16, an inline sensor 282 is provided at the subsequent stage of the treatment region in the fixing treatment unit 260. The inline sensor 282 is a sensor for reading the image formed on the recording medium 214 (for example, the designated-nozzle fast optimization test chart 10 in FIG. 3), and a CCD line sensor is suitably used.

(Ejecting Unit)

As shown in FIG. 16, the ejecting unit 270 is provided following the fixing treatment unit 260. The ejecting unit 270 is configured to include an endless feed chain 274 that is wound around stretching rollers 272A, 272B, and an ejection tray 276 in which the recording medium 214 after the image formation is contained.

The recording medium 214 after the fixing treatment that is sent from the fixing treatment unit 260 is fed by the feed chain 274, and is ejected to the ejection tray 276.

<Structure of Ink-Jet Head>

Next, an example of the structures of the ink-jet heads 248M, 248K, 248C, 248Y included in the drawing unit 240 is explained. Here, the structures of the ink-jet heads 248M, 248K, 248C, 248Y corresponding to the respective colors are common, and therefore, in the following, as a representative of these, an ink-jet head (head) is designated by reference numeral 50.

Figure 17A:
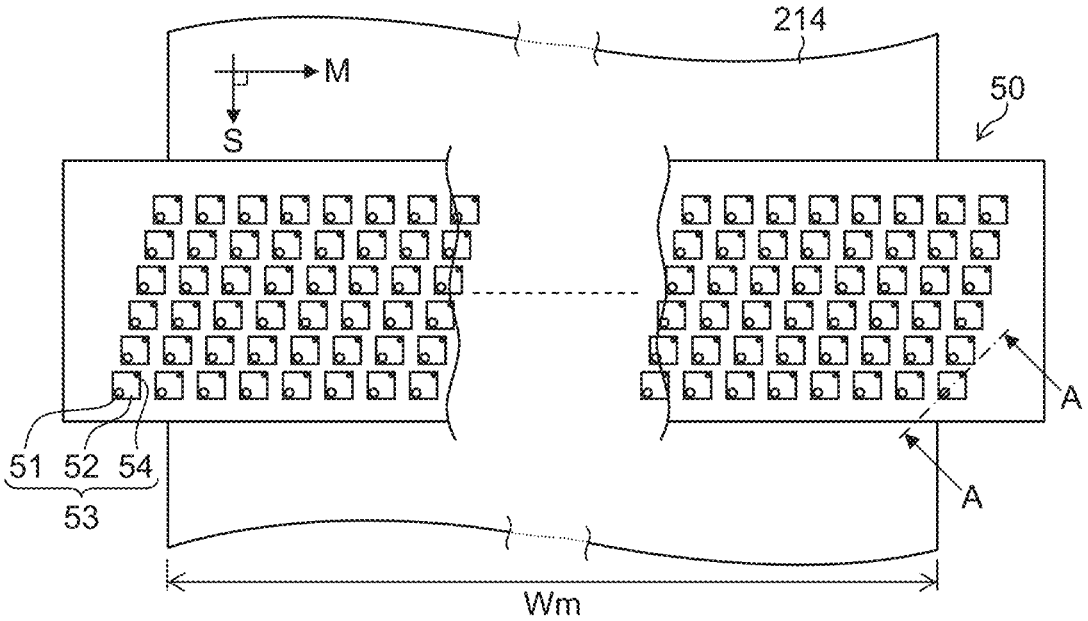
FIG. 17A is a diagram showing a structure example of an ink-jet head that is included in the ink-jet recording apparatus shown in FIG. 16.
Figure 17B:
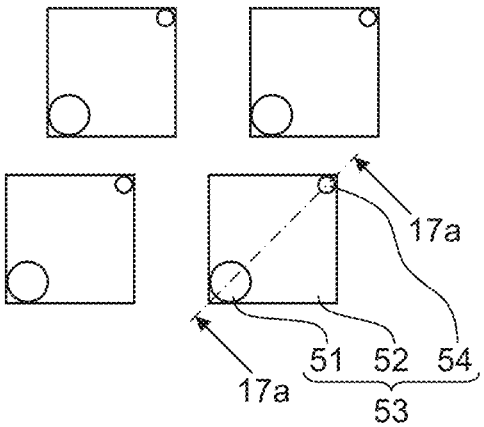
FIG. 17B is a partial enlarged diagram of FIG. 17A.
Figure 18:
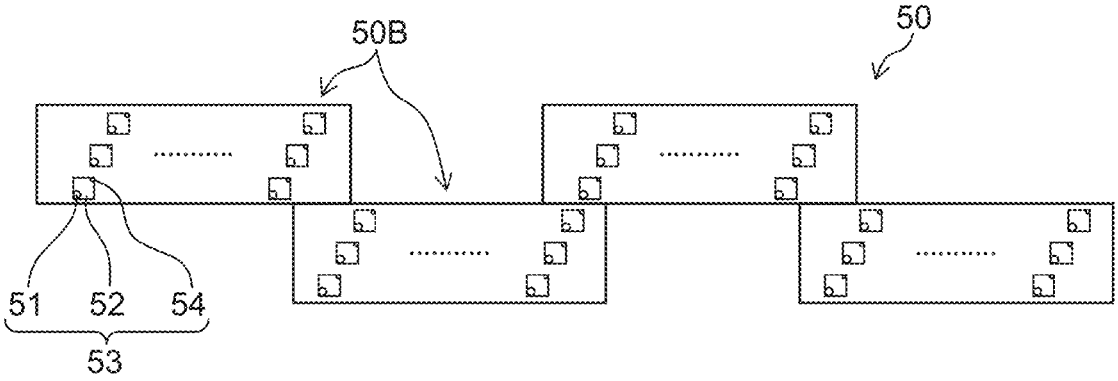
FIG. 18 is a diagram showing a head in which short head modules are arrayed in a zigzag manner.
Figure 19:
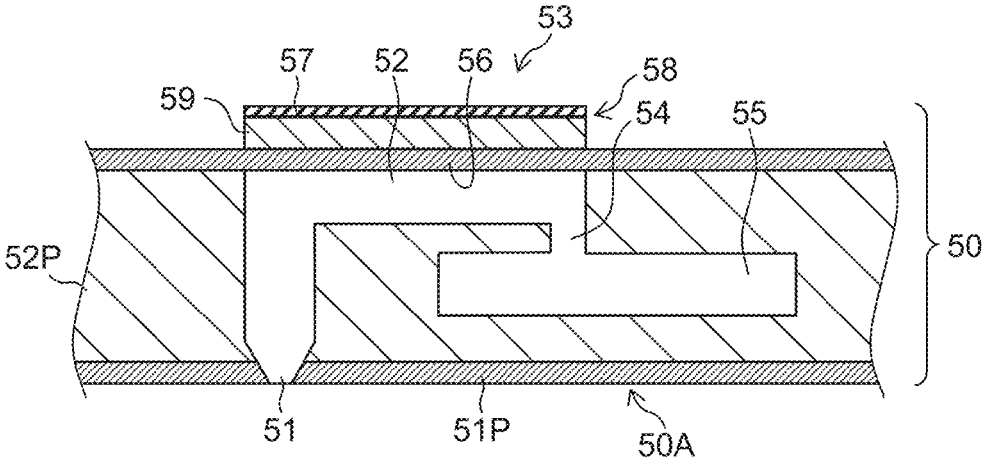
FIG. 19 is a cross-sectional diagram showing the steric configuration of a droplet discharge element.

FIG. 17A is a plan perspective diagram showing a structure example of the head 50, and FIG. 17B is a partial enlarged diagram of the head 50. Further, FIG. 18 is a plan perspective diagram showing another structure example of the head 50, and FIG. 19 is a cross-sectional diagram (a cross-sectional diagram taken along line 17*a*-17*a* in FIG. 17B) showing the steric configuration of a droplet discharge element (an ink chamber unit corresponding to one nozzle 51) equivalent to one channel that is the recording element unit.

As shown FIGS. 17A and 17B, in the head 50 according to the example, a plurality of nozzles 51 as ink discharge openings are arrayed over the whole width of the image formation region on the nozzle surface of the head 50 that faces the recording medium 214. This achieves a densification of substantial nozzle intervals (projected nozzle pitches) when being projected (orthogonally projected) so as to be arrayed along the longitudinal direction of the head (which is synonymous with the nozzle array direction M in FIG. 3).

The form for configuring, in the nozzle array direction M, a nozzle array having a length equal to or greater than the length corresponding to the whole width Wm of the recording medium 214 is not limited to the example. Instead of the configuration in FIG. 17A, for example, as shown in FIG. 18, a line head 50 that has a nozzle line of a length corresponding to the whole width of the recording medium 214 by arraying short head modules 50B, in each of which a plurality of nozzles 51 are two-dimensionally arrayed, in a zigzag manner, and by connecting them may be configured.

In the specification, the "perpendicular direction" includes a direction that, although being the intersection at an angle of less than 90° or more than 90°, can be regarded as being substantially the same as the intersection at an angle of 90° in terms of the operation effect, the function and the like.

In a pressure chamber 52 provided corresponding to each nozzle 51, whose planar shape is a roughly square shape (see FIGS. 17A and 17B), an outflow opening to the nozzle 51 is provided at one of both corner parts on the diagonal line, and an inflow opening (supply opening) 54 of the supply ink is provided at the other. Here, the shape of the pressure chamber 52 is not limited to the example, and the planar shape can be various shapes as exemplified by a polygon, such as a tetragon (a rhombus, a rectangle or the like), a pentagon and a hexagon, a circle and an ellipse.

As shown in FIG. 19, the head 50 has a structure in which a nozzle plate 51P, a passage plate 52P, a vibrating plate 56 and the like are laminated and joined. The nozzle plate 51P configures the nozzle surface 50A of the head 50, and the plurality of nozzles 51 each of which is connected with the pressure chamber 52 are two-dimensionally formed.

The passage plate 52P configures the side wall part of the pressure chamber 52, and therewith, is a passage forming member to form the supply opening 54 as the extraction part (the narrowest part) of an individual supply passage that leads the ink from a common passage 55 to the pressure chamber 52. Here, although being simply shown in FIG. 19 for convenience of explanation, the passage plate 52P has a structure in which a single or multiple substrates are laminated.

The vibrating plate 56, which configures a wall surface (the top surface in FIG. 19) of the pressure chamber 52, is composed of a conductive material, and serves also as a common electrode of a plurality of piezo-electric elements 58 that are arranged corresponding to the respective pressure chambers 52. Here, a mode in which the vibrating plate is formed of a non-conductive material such as resin is possible, and in this case, a common electrode layer of a conductive material such as metal is formed on the surface of the vibrating plate member.

In the vibrating plate 56, on the surface of the opposite side (the top side in FIG. 19) to the pressure chamber 52 side, piezo-electric bodies 59 are provided at positions corresponding to the respective pressure chambers 52, and individual electrodes 57 are formed on the top surfaces (the opposite side surface to the contact surface with the vibrating plate 56 that serves also as the common electrode) of the piezo-electric bodies 59. A piezo-electric element functioning as the piezo-electric element 58 is configured by the individual electrode 57, the common electrode (in the example, the vibrating plate 56 serves) that faces this, and the piezo-electric body 59 that is interposed between these electrodes.

Each of the pressure chambers 52 is connected with the common passage 55 through the supply opening 54. The common passage 55 is connected with an ink tank (not shown in the figure) that is an ink supply source, and the ink to be supplied from the ink tank is distributed and supplied to the respective pressure chambers 52 through the common passage 55.

When a drive voltage is applied between the individual electrode 57 and common electrode of the piezo-electric element 58, the piezo-electric element 58 is transformed so that the volume of the pressure chamber 52 is changed, and by a pressure change associated with this, the ink is discharged from the nozzle 51. When the piezo-electric element 58 becomes normal again from the displacement after the ink discharge, new ink passes through the supply opening 54 from the common passage 55, and is loaded into the pressure chamber 52.

Figure 20:
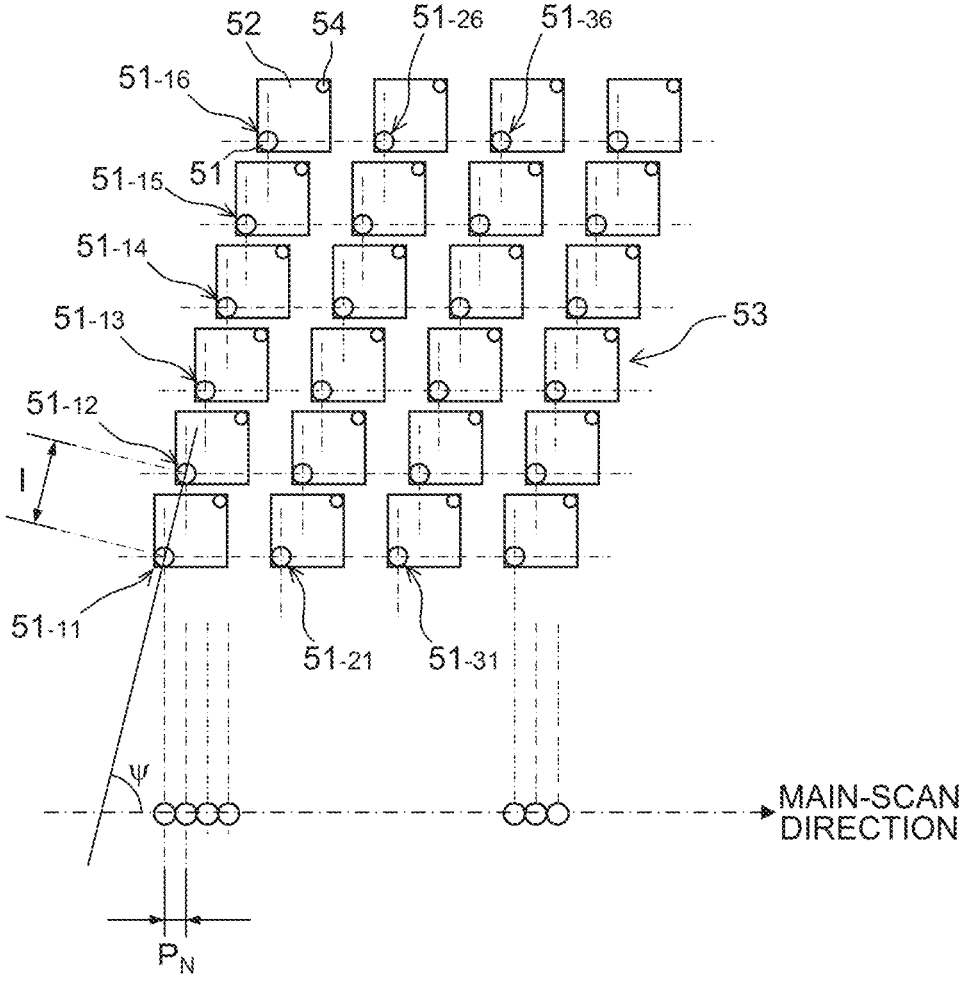
FIG. 20 is a diagram showing a nozzle arrangement in a matrix manner.

In the ink chamber units 53 having the above structure, as shown in FIG. 20, a structure in which the plurality of ink chamber units 53 are arrayed at a constant pitch 1 along the direction of a certain angle γ with respect to the main-scan direction (the nozzle array direction M, the first direction) can be handled as being equivalent to a structure in which the nozzles 51 are linearly arrayed substantially at a constant pitch $P_N=1\times\cos\psi$ in the main-scan direction.

In the nozzle arrangement in a matrix manner shown in FIG. 20, the nozzles 51-11, 51-12, 51-13, 51-14, 51-15 and 51-16 constitute one block (in addition, the nozzles 51-21, 51-22, 51-23, 51-24, 51-25 and 51-26 constitute one block, the nozzles 51-31, 51-32, 51-33, 51-34, 51-35 and 51-36 constitute one block, . . . ). The nozzles 51-11, 51-12, 51-13, 51-14, 51-15 and 51-16 are sequentially driven corresponding to the feed speed of the recording medium 214, and thereby, one line can be printed in the width direction of the recording medium 214.

Here, the nozzles at both sides to the nozzle 51-13 mean the nozzle 51-12 and the nozzle 51-14. That is, the non-discharge correction parameter for the nozzle 51-13 is applied to the nozzle 51-12 and the nozzle 51-14. Thus, in the embodiment, the nozzles at both sides mean the nozzles that land ink drops on the adjacent positions in the main-scan direction.

Meanwhile, the printing of the one line (a line by a single row of dots, or a line of multiple rows of dots) formed by the above main-scan is repeated in the recording medium feed direction while the recording medium 214 is being fed, and thereby, the printing in the sub-scan direction (second direction) is performed.

In the embodiment, the array form of the nozzles 51 in the head 50 is not limited to the illustrated example. For example, a nozzle array in a polygonal line manner such as a single-row linear array, a V-shaped nozzle array and a zigzag manner (W-shape or the like) in which the repeating unit is a V-shaped array can be adopted, instead of the matrix array explained in FIG. 8.

Further, the embodiment adopts a method in which an ink drop is jetted by the transformation of the piezo-electric element as typified by a piezo element. However, in the practice of the present invention, the ink discharge method is not particularly limited, and various methods such as a thermal jet method, in which a heating element such as a heater heats the ink to generate air bubbles and an ink drop is jetted by the pressure, can be adopted, instead of the piezo jet method.

<Explanation of Control System>

Figure 21:
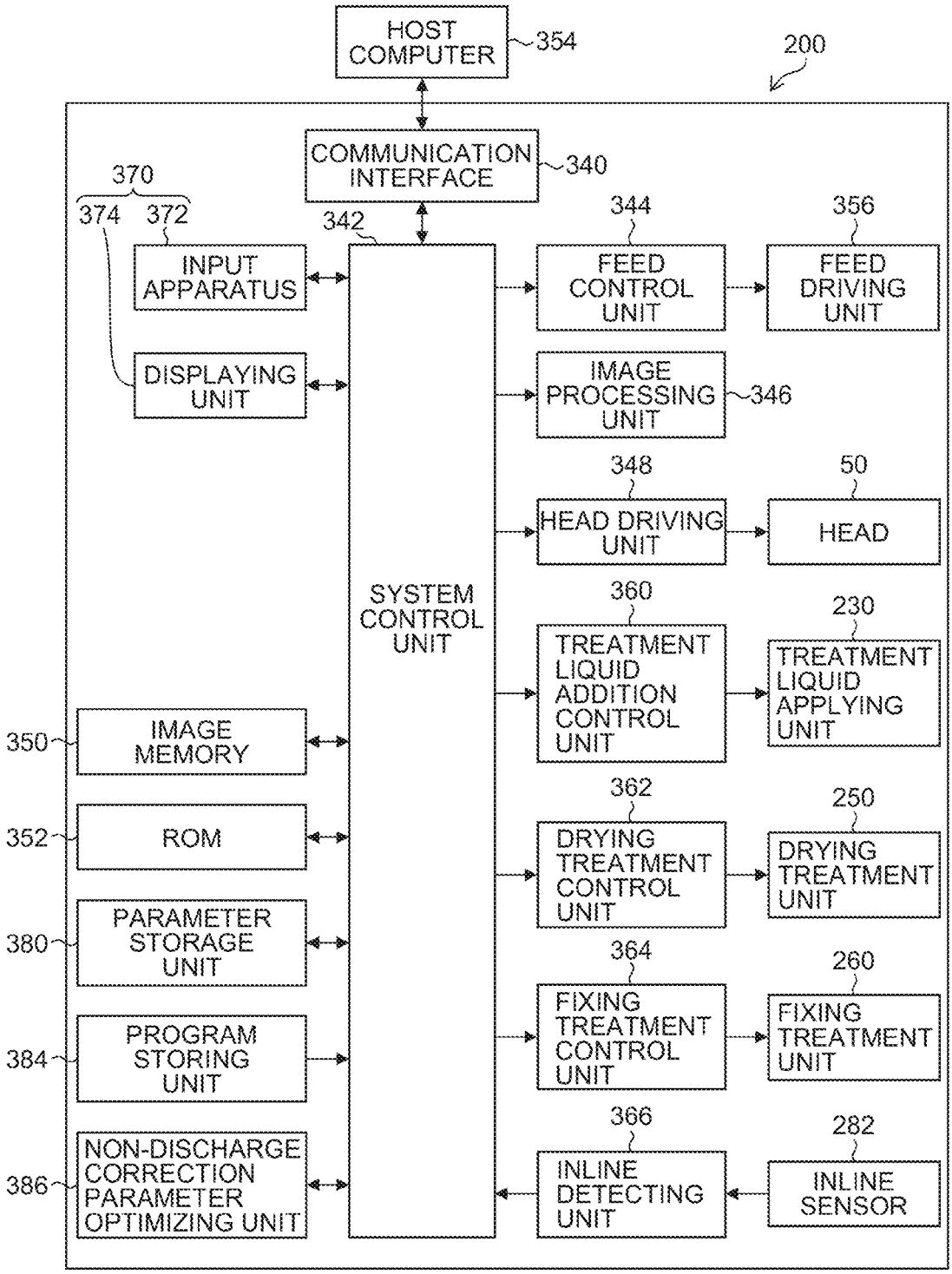
FIG. 21 is a block diagram showing the schematic configuration of a control system of the ink-jet recording apparatus shown in FIG. 16.

FIG. 21 is a block diagram showing the schematic configuration of a control system of the ink-jet recording apparatus 200. The ink-jet recording apparatus 200 includes an inline detecting unit 366, a non-discharge correction parameter optimizing unit 386 and the like, as well as a communication interface 340, a system control unit 342, a feed control unit 344, an image processing unit 346 and a head driving unit 348.

The communication interface 340 is an interface unit that receives image data sent from a host computer 354. As the communication interface 340, a serial interface may be applied, or a parallel interface may be applied. The communication interface 340 may be equipped with a buffer memory (not shown in the figure) for speeding up communication.

The system control unit 342, which is constituted by a central processing unit (CPU), the peripheral circuits and the like, functions as a control device to control the whole of the ink-jet recording apparatus 200 in accordance with a predetermined program, functions as an arithmetic device to perform various operations, and functions as a memory controller for an image memory 350 and a ROM 352. That is, the system control unit 342 controls the respective units such as the communication interface 340 and the feed control unit 344, performs the communication control with the host computer 354, the reading and writing control of the image memory 350 and the ROM 352, and the like, and generates control signals for controlling the above respective units.

Further, the system control unit 342 has functions equivalent to the functions of the control unit 150 shown in FIG. 7.

The image data send from the host computer 354 are imported into the ink-jet recording apparatus 200 through the communication interface 340, and a predetermined image process is performed by the image processing unit 346.

The image processing unit 346 is a control unit that has a signal (image) processing function to perform processes such as various manipulations for generating a printing control signal from the image data, and correction, and that supplies the generated printing data to the head driving unit 348. In the image processing unit 346, necessary signal processes are performed, and based on the image data, the droplet discharge amount (landing amount) and the discharge timing are controlled through the head driving unit 348. Thereby, an intended dot size or dot arrangement is actualized. Here, the head driving unit 348 shown in FIG. 21 may include a feedback control system for keeping the driving condition of the head 50 constant.

The feed control unit 344 controls the feed timing and feed speed of the recording medium 214 (see FIG. 16), based on the printing control signal generated by the image processing unit 346. A feed driving unit 356 in FIG. 21 includes a motor to rotate the impression cylinders 234, 244, 254, 264 in FIG. 16, a motor to rotate the transfer cylinders 232 to 262, a motor of the advancing mechanism for the recording medium 214 in the paper feeding unit 220, a motor to drive the stretching roller 272A (272B) of the ejecting unit 270 and the like. The feed control unit 344 functions as a controller for the above motors.

The image memory (primary storage memory) 350 has a function as a primary storage device that temporarily store the image data input through the communication interface 340, and a function as an expansion area of various programs stored in the ROM 352 and an operation work area of the CPU (for example, a work area of the image processing unit 346). As the image memory 350, a volatile memory (RAM), which can sequentially perform the reading and writing, is used.

In the ROM 352, programs to be executed by the CPU of the system control unit 342, various data necessary for the control by the respective units of the apparatus, control parameters and the like are stored, and the reading and writing of data are performed through the system control unit 342. The ROM 352 is not limited to a memory consisting of semiconductor elements, and a magnetic medium such as a hard disk may be used. Further, an external interface may be included and a detachable recording medium may be used.

Further, the ink-jet recording apparatus 200 includes a treatment liquid addition control unit 360, a drying treatment control unit 362 and a fixing treatment control unit 364, and controls the operation of each unit of the treatment liquid applying unit 230, the drying treatment unit 250 and the fixing treatment unit 260, respectively, in accordance with the instruction of the system control unit 342.

The treatment liquid addition control unit 360 controls the timing of the treatment liquid addition and controls the addition amount of the treatment liquid, based on the printing data obtained from the image processing unit 346. The drying treatment control unit 362 controls the timing of the drying treatment in the drying treatment apparatus 256, and controls the treatment temperature, the air-sending amount and the like. The fixing treatment control unit 364 controls the temperature of the heater 266 (see FIG. 16), and controls the pressing of the fixing roller 268.

Further, the inline detecting unit 366 shown in FIG. 21 is a processing block including a signal processing unit that performs predetermined signal processes such as noise removal, amplification and waveform shaping, to a reading signal output from the inline sensor 282 shown in FIG. 16. The system control unit 342 judges the presence or absence of abnormalities in the discharge of the head 50 based on the detection signal obtained by the inline detecting unit 366.

The ink-jet recording apparatus 200 shown in the example includes a user interface 370, and the user interface 370 is configured to include an input apparatus 372 with which an operator (user) performs various inputs, and a displaying unit (display) 374. As the input apparatus 372, various modes such as a keyboard, a mouse, a touch panel and a button can be adopted. By operating the input apparatus 372, an operator can perform the input of the print condition, the selection of the image quality mode, the input and editing of attached information, the search of information and the like, and a variety of information such as input contents and search results can be confirmed through the display of the displaying unit 374. Also, the displaying unit 374 functions as a device that displays alerts such as error messages.

In a parameter storage unit 380, various control parameters necessary for the operation of the ink-jet recording apparatus 200 are stored. The system control unit 342 appropriately reads the parameters necessary for the control, and executes the update (rewriting) the various parameters, as necessary. Further, the nozzle number of the non-discharge nozzle is stored as the non-discharge nozzle information.

The program storing unit 384 is a storage device in which a control program for the operation of the ink-jet recording apparatus 200 is stored.

The non-discharge correction parameter optimizing unit 386 is configured to include the non-discharge correction parameter storage unit 152, the test chart data generating unit 154, the test chart data storage unit 156, the test chart reading data storage unit 160 and the non-discharge correction parameter updating unit 164, which are shown in FIG. 7.

The test chart data generated by the non-discharge correction parameter optimizing unit 386 are input to the system control unit 342. The system control unit 342 drives the head 50 with the head driving unit 348, and records the test chart in the recording medium 214.

The test chart is read by the inline sensor 282 in FIG. 16, and is input by the system control unit 342 after the predetermined signal processes by the inline detecting unit 366. The non-discharge correction parameter optimizing unit 386 evaluates the reading data, and updates the non-discharge correction parameter.

The ink-jet recording apparatus 200 uses the updated and latest non-discharge correction parameter to make the ink-jet heads 248M, 248K, 248C, 248Y operate, and records, in the recording medium 214 (see FIG. 16), a high quality image in which an image degradation such as a white line caused by the non-discharge nozzle does not appear.

Here, in the apparatus configuration explained using FIG. 16 to FIG. 21, a modification, an addition, a deletion and the like can be arbitrarily performed.

The technical scope of the present invention is not limited to the scope of the description in the above embodiments. As for the configurations and the like in the embodiments, in the scope without departing from the spirit of the present invention, a modification, an addition, a deletion and the like can be arbitrarily performed, and also, the embodiments can be arbitrarily combined.

[Invention Disclosed in the Specification]

As understood from the descriptions of the embodiments of the present invention described in detail above, the specification contains the disclosure of various technical ideas including at least the following invention.

(First Aspect): an image recording apparatus including: a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element; a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, in which the defective-recording-element compensation parameter optimizing apparatus includes an analyzing device which analyzes reading data obtained by the reading device, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region.

According to this aspect, when the defective-recording-element compensation parameter for a designated recording element previously designated is optimized, the measurement chart to which the plurality of defective-recording-element compensation parameters are continuously or intermittently given is used, and the defective-recording-element compensation parameter corresponding to the concentration at the measurement chart that minimizes the difference value between the concentration value at the measurement chart, which is given at the measurement chart for each defective-recording-element compensation parameter, and the concentration value at the uniform concentration region is derived as the optimum value of the defective-recording-element compensation parameter for the designated recording element. Therefore, the defective-recording-element compensation parameter for the designated recording element is efficiently optimized.

It is preferable to be an aspect including a first test chart data forming device which forms first test chart data, an updating device which updates the defective-recording-element compensation parameter for the designated recording element, and a storage device which stores the updated defective-recording-element compensation parameter for the designated recording element. Further, it is preferable to be an aspect including a designating device which designates the designated recording element.

It is preferable to be an aspect in which the non-recording region and the measurement chart region are formed so as to be arrayed along the first direction. Further, it is preferable to be an aspect in which each of the non-recording region and the measurement chart is formed along the second direction perpendicular to the first direction.

(Second Aspect): in the image recording apparatus according to the first aspect, the analyzing device applies a difference value between an average concentration value at a target defect extremely-vicinal region and an average concentration value at a target defect roughly-vicinal region, as an evaluation index of the optimum value of the defective-recording-element compensation parameter, and derives a defective-recording-element compensation parameter given at the target defect extremely-vicinal region that minimizes the difference value, as the optimum value of the defective-recording-element compensation parameter for the designated recording element, the target defect extremely-vicinal region being a region for each defective-recording-element compensation parameter in the measurement chart region and the non-recording region, the target defect roughly-vicinal region being a region that is in the uniform concentration region and corresponds to the target defect extremely-vicinal region.

Examples of the "target defect extremely-vicinal region" include an aspect in which it is formed from the non-recording region and the measurement chart region at the same position in the second direction.

Examples of the "target defect roughly-vicinal region" include an aspect in which it is the uniform concentration region at the same position as the target defect extremely-vicinal region in the second direction.

The "target defect roughly-vicinal region" may be formed at one side in the first direction to the "target defect extremely-vicinal region", or may be formed at both sides.

(Third Embodiment): in the image recording apparatus to the first aspect or the second aspect, when an optimizing process of the defective-recording-element compensation parameter for the designated recording element is executed multiple times, the forming device narrows a range of the plurality of the defective-recording-element compensation parameters to be applied to the measurement chart relative to the last time, and then forms the measurement chart, the optimizing process including processes by the forming device, the reading device and the analyzing device.

According to this aspect, when the defective-recording-element compensation parameter is optimized by the multiple-time repetitive process, the range of the defective-recording-element compensation parameter is narrowed as the number of processing increases, and thereby, the defective-recording-element compensation parameter is optimized more efficiently.

The range of the defective-recording-element compensation parameter may be the whole range in the first processing, or the defective-recording-element compensation parameter may be narrowed down from the first processing.

(Fourth Aspect): in the image recording apparatus according to any of the first aspect to the third aspect, when the designated recording element is an already-known defective recording element, the forming device forms the first test chart such that the recording position of the designated recording element is the non-recording region and the recording position of the defect-compensation recording element that compensates the recording defect of the designated recording element is the measurement chart region.

According to this aspect, the already-known defective recording element is set as the designated recording element, resulting in the achievement of the optimization of the defective-recording-element compensation parameter in consideration of the already-known defective recording element.

(Fifth Aspect): in the image recording apparatus according to any of the first aspect to the third aspect, when the designated recording element is a normal recording element, the forming device forms the first test chart such that the recording position of the designated recording element is the measurement chart region and the recording position of the defective recording element for which the designated recording element compensates the recording defect is the non-recording region.

According to this aspect, for a recording element designated by a previously determined condition, the defective-recording-element compensation parameter is efficiently optimized.

(Sixth Aspect): in the image recording apparatus according to any of the first aspect to the fifth aspect, the forming device forms such a measurement chart that sub-regions respectively corresponding to the plurality of the defective-recording-element compensation parameters continue at the measurement chart region.

According to this aspect, the sub-regions configuring the measurement chart continue, and therefore, in the reading of the first test chart using an optical reading apparatus, it is possible to inhibit the influence of reflected light on the reading data.

(Seventh Aspect): in the image recording apparatus according to any of the first aspect to the sixth aspect, when defective-recording-element compensation parameters for other recording elements except the designated recording element are optimized after the defective-recording-element compensation parameter for the designated recording element is optimized, the forming device forms a second test chart, the second test chart being a test chart that has a simulated defective recording region, a defective-recording-element compensation region and a uniform concentration region, and in which a plurality of patterns each of which has as one stage a plurality of the simulated defective recording regions and the defective-recording-element compensation regions arranged in a first direction at a previously determined interval are arranged in a second direction perpendicular to the first direction and the simulated defective recording regions belonging to different stages are arranged such that positions in the first direction are deviated, the simulated defective recording region being a region where a non-recording is provided at a recording position of a simulated defective recording element that is regarded as a defective recording element of the other recording elements, the defective-recording-element compensation region being a region where a compensation pattern is applied at a recording position of a defect-compensation recording element that is a recording element to compensate the recording defect of the simulated defective recording element, the compensation pattern having a concentration value to which a defective-recording-element compensation parameter for the simulated defective recording element is applied, the uniform concentration region being a region where a uniform concentration image with a concentration value of the processing target is formed, the reading device reads the formed second test chart, and the analyzing device analyzes reading data of the second test chart obtained by the reading device, evaluates a corrected intensity of the defective-recording-element compensation parameter for each of the recording elements, and optimizes the defective-recording-element compensation parameter for each of the other recording elements from the evaluated corrected intensity, based on a single-variable root-finding algorithm using an iterative method.

According to this aspect, by utilizing the defective-recording-element compensation parameter optimizing scheme according to the first aspect to the sixth aspect, for all the recording elements included in a recording head, the defective-recording-element compensation parameters can be suitably optimized in consideration of an already-known defective-recording-element and the like.

In this aspect, it is preferable to be an aspect in which the Brent method is used as the single-variable root-finding algorithm using an iterative method.

In this aspect, it is preferable to be an aspect in which the upper limit of the number of times is previously determined and the control device repetitively executes the operation.

In this aspect, it is preferable to be an aspect that includes a judging device to judge whether the evaluated corrected intensity is less than a predetermined value and in which the control device repetitively executes the operation until the judgment that the evaluated corrected intensity is less than the predetermined value is made.

In this aspect, it is preferable to be an aspect in which the second test chart includes the simulated non-discharge region formed by a first nozzle, the non-discharge correction region formed by second nozzles that are nozzles at both sides to the first nozzle, and the uniform concentration region formed by third nozzles other than the first nozzle and the second nozzles, the plurality of stages in each of which the simulated non-discharge regions are arranged in the first direction at a predetermined interval are arranged in the second direction to perpendicular to the first direction, the simulated non-discharge regions in the plurality of stages are arranged at different first-directional positions from each other, and the test chart data are such data that the first nozzle does not discharge ink, the third nozzle discharges ink in accordance with a command value of a predetermined concentration, and the second nozzle discharges ink in accordance with a command value in which the command value of the predetermined concentration has been corrected by the non-discharge correction parameter for the adjacent first nozzle.

In this aspect, it is preferable to be an aspect in which the second test chart further includes a reference region stage where all nozzles discharge ink in accordance with a command value of a predetermined concentration.

In this aspect, it is preferable to be an aspect in which the corrected intensity is the difference amount between the concentration value of the reading data near the simulated non-discharge region and the concentration value of a predetermined concentration.

In this aspect, it is preferable to be an aspect in which the non-discharge correction parameter for each nozzle is prepared for each concentration and the control device optimizes a non-discharge correction parameter for a command value of a predetermined concentration.

In this aspect, it is preferable to be an aspect in which the non-discharge correction parameter for each nozzle includes a plurality of parameters to be designated by a common variable and a parameter updating device updates the common variable.

(Eighth Aspect): in the image recording apparatus according to the seventh aspect, when the defective-recording-element compensation parameter for the designated recording element is optimized, the forming device forms a third test chart instead of forming the first test chart, the third test chart being a test chart in which a first chart corresponding to the first test chart and a second chart corresponding to the second test chart are mixed, the first chart being formed at the recording position of the designated recording element and at a recording position of a recording element near the designated recording element, the second chart being formed at the recording position of the designated recording element and at recording positions of other recording elements except the recording element near the designated recording element, the reading device reads the formed third test chart, and the analyzing device analyzes reading data of the first test chart in reading data of the third test chart acquired by the reading device, and derives an optimum value of the defective-recording-element compensation parameter for the designated recording element.

This aspect uses the third test chart in which the first chart corresponding to the first test chart and the second chart corresponding to the second test chart are mixed. A defective-recording-element compensation parameter optimizing scheme using the first chart is applied to the designated recording element and the recording element near the designated recording element, and a defective-recording-element compensation parameter optimizing scheme using the second chart is applied to the other recording elements except the designated recording element and the recording element near the designated recording element. The two are collectively performed, resulting in the achievement of a more efficient optimization of the defective-recording-element compensation parameter in consideration of the designated recording element.

As an example of the "recording element near the designated recording element", there is a recording element whose recording position is an operation target region in the optimization process of the defective-recording-element compensation parameter for the designated recording element.

(Ninth Aspect): in the image recording apparatus according to the eighth aspect, the analyzing device optimizes the defective-recording-element compensation parameter for the defective recording element, without processing the uniform concentration region of the first chart in the third test chart.

According to this aspect, the uniform concentration region of the first chart in the third test chart is not processed, resulting in a suitable optimization of the defective-recording-element compensation parameter for the designated recording element and the recording element near the designated recording element.

(Tenth Aspect): in the image recording apparatus according to the eighth aspect or the ninth aspect, when defective-recording-element compensation parameters for other recording elements except the designated recording element are optimized after the defective-recording-element compensation parameter for the designated recording element is optimized by using the third test chart, the forming device forms a fourth test chart, the fourth test chart being a test chart in which the second chart corresponding to the second test chart is formed at the uniform concentration region of the first chart in the third test chart, the reading device reads the formed fourth test chart, the analyzing device analyzes reading data of the second chart in reading data of the fourth test chart acquired by the reading device, and derives an optimum value of the defective-recording-element compensation parameter for the recording element near the designated recording element.

This aspect uses the fourth test chart, to optimize the defective-recording-element compensation parameter for the uniform concentration region of the first chart in the third test chart, separately from the non-recording region and measurement chart region of the first chart in the third test chart, and thereby, is not influenced by the optimization of the defective-recording-element compensation parameter for the designated recording element.

(Eleventh Aspect): a defective-recording-element compensation parameter optimizing method that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element, in which the defective-recording-element compensation parameter optimizing method includes: a forming step of forming a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; a reading step of reading the formed first test chart; and an analyzing step of analyzing reading data obtained by the reading step, comparing a concentration at the measurement chart with the concentration at the uniform concentration region for each defective-recording-element compensation parameter, and, as an optimum value of the defective-recording-element compensation parameter for the designated recording element, deriving a defective-recording-element compensation parameter corresponding to a concentration at the measurement chart that minimizes a concentration difference from the uniform concentration region.

According to this aspect, in the optimization of the defective-recording-element compensation parameter for the designated recording element designated previously, the measurement chart to which a plurality of defective-recording-element compensation parameters are continuously or intermittently given is used. Then, the defective-recording-element compensation parameter that minimizes the difference value between the concentration value at the measurement chart for each defective-recording-element compensation parameter given to the measurement chart and the concentration value of the uniform concentration region is derived as the optimum value at the defective-recording-element compensation parameter for the designated recording element. Therefore, the defective-recording-element compensation parameter for the designated recording element is efficiently optimized.

It is preferable to be an aspect that includes a first test chart data forming step of forming first test chart data, an updating step of updating the defective-recording-element compensation parameter for the designated recording element, and a storing step of storing the updated defective-recording-element compensation parameter for the designated recording element. Further, it is preferable to be an aspect that includes a designating step of designating the designated recording element.

(Twelfth Aspect): a defective-recording-element compensation parameter optimizing program making a computer implement functions of: a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element; a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, in which the defective-recording-element compensation parameter optimizing program makes the defective-recording-element compensation parameter optimizing apparatus implement a function of an analyzing device which analyzes reading data obtained by the reading device, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region.

(Thirteenth Aspect): a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element, in which the defective-recording-element compensation parameter optimizing apparatus includes an analyzing device which analyzes reading data obtained by reading a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region.

(Fourteenth Aspect): a defective-recording-element compensation parameter optimizing method that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element, in which the defective-recording-element compensation parameter optimizing method includes an analyzing step of analyzing reading data obtained by reading a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded, comparing a concentration at the measurement chart with the concentration at the uniform concentration region for each defective-recording-element compensation parameter, and, as an optimum value of the defective-recording-element compensation parameter for the designated recording element, deriving a defective-recording-element compensation parameter corresponding to a concentration at the measurement chart that minimizes a concentration difference from the uniform concentration region.

(Fifteenth Aspect): a defective-recording-element compensation parameter optimizing program for optimizing a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element, in which the defective-recording-element compensation parameter optimizing program makes a computer execute a function of an analyzing device which analyzes reading data of a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region.

(Sixteenth Aspect): a non-transitory recording medium in which a computer-readable code of the program according to the twelfth aspect is stored.

(Seventeenth Aspect): a non-transitory recording medium in which a computer-readable code of the program according to the fifteenth aspect is stored.

What is claimed is:

1. An image recording apparatus comprising:

a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element;

a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, wherein the defective-recording-element compensation parameter optimizing apparatus comprises an analyzing device which analyzes reading data obtained by the reading device, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region, wherein, when an optimizing process of the defective-recording-element compensation parameter for the designated recording element is executed multiple times, the forming device narrows a range of the plurality of the defective-recording-element compensation parameters to be applied to the measurement chart relative to the last time, and then forms the measurement chart, the optimizing process including processes by the forming device, the reading device and the analyzing device.

2. The image recording apparatus according to claim 1, wherein the analyzing device applies a difference value between an average concentration value at a target defect extremely-vicinal region and an average concentration value at a target defect roughly-vicinal region, as an evaluation index of the optimum value of the defective-recording-element compensation parameter, and derives a defective-recording-element compensation parameter given at the target defect extremely-vicinal region that minimizes the difference value, as the optimum value of the defective-recording-element compensation parameter for the designated recording element, the target defect extremely-vicinal region being a region for each defective-recording-element compensation parameter in the measurement chart region and the non-recording region, the target defect roughly-vicinal region being a region that is in the uniform concentration region and corresponds to the target defect extremely-vicinal region.

3. The image recording apparatus according to claim 1, wherein, when the designated recording element is an already-known defective recording element, the forming device forms the first test chart such that the recording position of the designated recording element is the non-recording region and the recording position of the defect-compensation recording element that compensates the recording defect of the designated recording element is the measurement chart region.

4. The image recording apparatus according to claim 1, wherein, when the designated recording element is a normal recording element, the forming device forms the first test chart such that the recording position of the designated recording element is the measurement chart region and the recording position of the defective recording element for which the designated recording element compensates the recording defect is the non-recording region.

5. The image recording apparatus according to claim 1, wherein the forming device forms such a measurement chart that sub-regions respectively corresponding to the plurality of the defective-recording-element compensation parameters continue at the measurement chart region.

6. An image recording apparatus comprising:

a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element;

a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, wherein the defective-recording-element compensation parameter optimizing apparatus comprises an analyzing device which analyzes reading data obtained by the reading device, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region, wherein, when defective-recording-element compensation parameters for other recording elements except the designated recording element are optimized after the defective-recording-element compensation parameter for the designated recording element is optimized, the forming device forms a second test chart, the second test chart being a test chart that has a simulated defective recording region, a defective-recording-element compensation region and a uniform concentration region, and in which a plurality of patterns each of which has as one stage a plurality of the simulated defective recording regions and the defective-recording-element compensation regions arranged in a first direction at a previously determined interval are arranged in a second direction perpendicular to the first direction and the simulated defective recording regions belonging to different stages are arranged such that positions in the first direction are deviated, the simulated defective recording region being a region where a non-recording is provided at a recording position of a simulated defective recording element that is regarded as a defective recording element of the other recording elements, the defective-recording-element compensation region being a region where a compensation pattern is applied at a recording position of a defect-compensation recording element that is a recording element to compensate the recording defect of the simulated defective recording element, the compensation pattern having a concentration value to which a defective-recording-element compensation parameter for the simulated defective recording element is applied, the uniform concentration region being a region where a uniform concentration image with a concentration value of the processing target is formed, the reading device reads the formed second test chart, and the analyzing device analyzes reading data of the second test chart obtained by the reading device, evaluates a corrected intensity of the defective-recording-element compensation parameter for each of the recording elements, and optimizes the defective-recording-element compensation parameter for each of the other recording elements from the evaluated corrected intensity, based on a single-variable root-finding algorithm using an iterative method.

7. The image recording apparatus according to claim 6, wherein, when the defective-recording-element compensation parameter for the designated recording element is optimized, the forming device forms a third test chart instead of forming the first test chart, the third test chart being a test chart in which a first chart corresponding to the first test chart and a second chart corresponding to the second test chart are mixed, the first chart being formed at the recording position of the designated recording element and at a recording position of a recording element near the designated recording element, the second chart being formed at the recording position of the designated recording element and at recording positions of other recording elements except the recording element near the designated recording element, the reading device reads the formed third test chart, and the analyzing device analyzes reading data of the first test chart in reading data of the third test chart acquired by the reading device, and derives an optimum value of the defective-recording-element compensation parameter for the designated recording element.

8. The image recording apparatus according to claim 7, wherein the analyzing device optimizes the defective-recording-element compensation parameter for the designated recording element, without processing the uniform concentration region of the first chart in the third test chart.

9. The image recording apparatus according to claim 7, wherein, when defective-recording-element compensation parameters for other recording elements except the designated recording element are optimized after the defective-recording-element compensation parameter for the designated recording element is optimized by using the third test chart, the forming device forms a fourth test chart, the fourth test chart being a test chart in which the second chart corresponding to the second test chart is formed at the uniform concentration region of the first chart in the third test chart, the reading device reads the formed fourth test chart, the analyzing device analyzes reading data of the second chart in reading data of the fourth test chart acquired by the reading device, and derives an optimum value of the defective-recording-element compensation parameter for the recording element near the designated recording element.

10. A defective-recording-element compensation parameter optimizing method that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element, wherein the defective-recording-element compensation parameter optimizing method comprises:

a forming step of forming a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded;

a reading step of reading the formed first test chart; and an analyzing step of analyzing reading data obtained by the reading step, comparing a concentration at the measurement chart with the concentration at the uniform concentration region for each defective-recording-element compensation parameter, and, as an optimum value of the defective-recording-element compensation parameter for the designated recording element, deriving a defective-recording-element compensation parameter corresponding to a concentration at the measurement chart that minimizes a concentration difference from the uniform concentration region, wherein, when an optimizing process of the defective-recording-element compensation parameter for the designated recording element is executed multiple times, the forming device narrows a range of the plurality of the defective-recording-element compensation parameters to be applied to the measurement chart relative to the last time, and then forms the measurement chart, the optimizing process including processes by the forming device, the reading device and the analyzing device.

11. A non-transitory recording medium in which a computer-readable code of a defective-recording-element compensation parameter optimizing program is stored, the defective-recording-element compensation parameter optimizing program making a computer implement functions of:

a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element;

a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, wherein the defective-recording-element compensation parameter optimizing program makes the defective-recording-element compensation parameter optimizing apparatus implement a function of an analyzing device which analyzes reading data obtained by the reading device, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region, wherein, when an optimizing process of the defective-recording-element compensation parameter for the designated recording element is executed multiple times, the forming device narrows a range of the plurality of the defective-recording-element compensation parameters to be applied to the measurement chart relative to the last time, and then forms the measurement chart, the optimizing process including processes by the forming device, the reading device and the analyzing device.

12. A defective-recording-element compensation parameter optimizing method that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element, wherein the defective-recording-element compensation parameter optimizing method comprises:

a forming step of forming a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded;

a reading step of reading the formed first test chart; and an analyzing step of analyzing reading data obtained by the reading step, comparing a concentration at the measurement chart with the concentration at the uniform concentration region for each defective-recording-element compensation parameter, and, as an optimum value of the defective-recording-element compensation parameter for the designated recording element, deriving a defective-recording-element compensation parameter corresponding to a concentration at the measurement chart that minimizes a concentration difference from the uniform concentration region, wherein, when defective-recording-element compensation parameters for other recording elements except the designated recording element are optimized after the defective-recording-element compensation parameter for the designated recording element is optimized, the forming device forms a second test chart, the second test chart being a test chart that has a simulated defective recording region, a defective-recording-element compensation region and a uniform concentration region, and in which a plurality of patterns each of which has as one stage a plurality of the simulated defective recording regions and the defective-recording-element compensation regions arranged in a first direction at a previously determined interval are arranged in a second direction perpendicular to the first direction and the simulated defective recording regions belonging to different stages are arranged such that positions in the first direction are deviated, the simulated defective recording region being a region where a non-recording is provided at a recording position of a simulated defective recording element that is regarded as a defective recording element of the other recording elements, the defective-recording-element compensation region being a region where a compensation pattern is applied at a recording position of a defect-compensation recording element that is a recording element to compensate the recording defect of the simulated defective recording element, the compensation pattern having a concentration value to which a defective-recording-element compensation parameter for the simulated defective recording element is applied, the uniform concentration region being a region where a uniform concentration image with a concentration value of the processing target is formed, the reading device reads the formed second test chart, and the analyzing device analyzes reading data of the second test chart obtained by the reading device, evaluates a corrected intensity of the defective-recording-element compensation parameter for each of the recording elements, and optimizes the defective-recording-element compensation parameter for each of the other recording elements from the evaluated corrected intensity, based on a single-variable root-finding algorithm using an iterative method.

13. A non-transitory recording medium in which a computer-readable code of a defective-recording-element compensation parameter optimizing program is stored, the defective-recording-element compensation parameter optimizing program making a computer implement functions of:

a defective-recording-element compensation parameter optimizing apparatus that optimizes a defective-recording-element compensation parameter, the defective-recording-element compensation parameter being applied to an image recording that uses a recording head including a plurality of recording elements and being applied to a defect-compensation recording element when a recording defect by a defective recording element is compensated by using the defect-compensation recording element, the defective recording element having become unable to perform a normal recording, the defect-compensation recording element being other than the defective recording element;

a forming device which forms a first test chart having a non-recording region, a measurement chart region and a uniform concentration region, the non-recording region being a region where a non-recording is provided at a recording position of a designated recording element previously designated or a region where a non-recording is provided at a recording position of a defective recording element for which the designated recording element compensates the recording defect, the measurement chart region being a region where a measurement chart to which a plurality of defective-recording-element compensation parameters are continuously or intermittently given is formed at a recording position of a defect-compensation recording element that compensates the recording defect at the non-recording region, the uniform concentration region being a region where a uniform concentration image with a processing target concentration is recorded; and a reading device which reads the formed first test chart, wherein the defective-recording-element compensation parameter optimizing program makes the defective-recording-element compensation parameter optimizing apparatus implement a function of an analyzing device which analyzes reading data obtained by the reading device, which compares a concentration at the measurement chart with the concentration at the uniform concentration region for each defective-recording-element compensation parameter, and which, as an optimum value of the defective-recording-element compensation parameter for the designated recording element, derives a defective-recording-element compensation parameter corresponding to a concentration at the measurement chart that minimizes a concentration difference from the uniform concentration region, wherein, when defective-recording-element compensation parameters for other recording elements except the designated recording element are optimized after the defective-recording-element compensation parameter for the designated recording element is optimized, the forming device forms a second test chart, the second test chart being a test chart that has a simulated defective recording region, a defective-recording-element compensation region and a uniform concentration region, and in which a plurality of patterns each of which has as one stage a plurality of the simulated defective recording regions and the defective-recording-element compensation regions arranged in a first direction at a previously determined interval are arranged in a second direction perpendicular to the first direction and the simulated defective recording regions belonging to different stages are arranged such that positions in the first direction are deviated, the simulated defective recording region being a region where a non-recording is provided at a recording position of a simulated defective recording element that is regarded as a defective recording element of the other recording elements, the defective-recording-element compensation region being a region where a compensation pattern is applied at a recording position of a defect-compensation recording element that is a recording element to compensate the recording defect of the simulated defective recording element, the compensation pattern having a concentration value to which a defective-recording-element compensation parameter for the simulated defective recording element is applied, the uniform concentration region being a region where a uniform concentration image with a concentration value of the processing target is formed, the reading device reads the formed second test chart, and the analyzing device analyzes reading data of the second test chart obtained by the reading device, evaluates a corrected intensity of the defective-recording-element compensation parameter for each of the recording elements, and optimizes the defective-recording-element compensation parameter for each of the other recording elements from the evaluated corrected intensity, based on a single-variable root-finding algorithm using an iterative method.

* * * * *